US008094859B2

(12) United States Patent
Suematsu et al.

(10) Patent No.: US 8,094,859 B2
(45) Date of Patent: Jan. 10, 2012

(54) DIPOLE ANTENNA DEVICE, EARPHONE ANTENNA DEVICE, AND WIRELESS COMMUNICATION TERMINAL DEVICE CONNECTED TO THE DEVICE

(75) Inventors: Eiji Suematsu, Nara (JP); Miyoshi Yamauchi, Osaka (JP); Motofumi Yamaguchi, Osaka (JP); Mitsuhiro Noboru, Tondabayashi (JP)

(73) Assignee: Sharp Kabushiki Kaisha, Osaka (JP)

( * ) Notice: Subject to any disclaimer, the term of this patent is extended or adjusted under 35 U.S.C. 154(b) by 1062 days.

(21) Appl. No.: 11/954,849

(22) Filed: Dec. 12, 2007

(65) Prior Publication Data

US 2008/0170739 A1 Jul. 17, 2008

(30) Foreign Application Priority Data

Dec. 14, 2006 (JP) ..... 2006-337411

(51) Int. Cl.
*H04R 1/10* (2006.01)

(52) U.S. Cl. ..... 381/384; 381/370; 381/374; 381/376; 381/377; 381/378; 381/315; 381/309; 381/72; 381/74; 379/438; 379/430

(58) Field of Classification Search ..... 381/380, 381/384, 370, 374, 376, 377, 378, 315, 309, 381/72, 74; 379/438, 430
See application file for complete search history.

(56) References Cited

U.S. PATENT DOCUMENTS 7,298,251 B2 * 11/2007 Meyers et al. ..... 340/505
7,330,553 B2 * 2/2008 Nishiguchi et al. ..... 381/74
7,843,394 B2 * 11/2010 Egawa et al. ..... 343/702
2004/0150570 A1 * 8/2004 Yuasa et al. ..... 343/702
2005/0266875 A1 12/2005 Yegin et al.
2006/0050893 A1 * 3/2006 Petros ..... 381/74

FOREIGN PATENT DOCUMENTS

| | | | |
|---|---|---|---|
| JP | 64-68507 | A | 3/1989 |
| JP | 3-171904 | A | 7/1991 |
| JP | 3-109414 | | 11/1991 |
| JP | 2004-236117 | | 8/2004 |
| JP | 2004-274691 | | 9/2004 |
| JP | 2005-64742 | A | 3/2005 |
| JP | 2005-159727 | | 6/2005 |

* cited by examiner

*Primary Examiner* — Tom Thomas
*Assistant Examiner* — Benjamin Tzu-Hung Liu
(74) *Attorney, Agent, or Firm* — Birch, Stewart, Kolasch & Birch, LLP

(57) ABSTRACT

An earphone antenna device operable to be connected with a wireless communication terminal device includes: earphone cables, connected with earphone sections, respectively, for supplying audio signals; an audio cable one end of which is connected with the wireless communication terminal device and the other end is connected with the earphone cables; and a coaxial cable one end of which is connected with the wireless communication terminal device and the other end is connected with a pair of string-shaped antenna elements integrated with the earphone cables. The earphone cables are insulated from the antenna elements and the audio cable is insulated from the coaxial cable. This provides a dipole antenna device and an earphone antenna device hardly influenced by noises from the wireless communication terminal device and noises transmitted via the audio cable. Further, a wireless communication terminal device to be connected with the antenna devices is provided.

16 Claims, 14 Drawing Sheets

DIPOLE ANTENNA DEVICE, EARPHONE ANTENNA DEVICE, AND WIRELESS COMMUNICATION TERMINAL DEVICE CONNECTED TO THE DEVICE

This non-provisional application claims priority under 35 U.S.C. §119(a) on Patent Application No. 2006-337411 filed in Japan on Dec. 14, 2006, the entire contents of which are hereby incorporated by reference.

FIELD OF THE INVENTION

The present invention relates to: a dipole antenna device and an earphone antenna device each of which is operable to be connected with a terminal device having a wireless communication function; and a wireless communication terminal device connected with the dipole antenna device or the earphone antenna device. The present invention particularly relates to: a dipole antenna device and an earphone antenna device in each of which a pair of antenna elements are provided with an antenna coaxial cable; and a wireless communication terminal device connected with the dipole antenna device or the earphone antenna device.

BACKGROUND OF THE INVENTION

Earphone antennas that are integrally formed to serve both as earphones/headphones and antennas have been used for portable radio terminal devices, portable TV receivers, and wireless communication terminal devices having radio and/or TV functions.

For example, Patent Document 1 (Japanese Unexamined Patent Publication No. 2005-64742 (Tokukai 2005-64742; published on Mar. 10, 2005) discloses a structure illustrated in FIG. 15 that is one of the above earphone antennas. This earphone antenna has a sleeve antenna structure in which a coaxial cable 926 is extended from a wireless communication terminal device, a central conductor (inner conductor) 924 of the coaxial cable 926 is extended from an end of a shield line (outer conductor) 925, and a sleeve antenna is excited by the extended central conductor 924 and the shield line 925.

With the structure, an earphone antenna 900 in which an audio signal and a high-frequency signal received by an antenna are overlapped with each other is obtained.

In the earphone antenna 900 having the above structure, one cable serves as both an audio signal cable and an antenna cable.

Specifically, the central conductor 924 of the coaxial cable 926 is directly connected with a signal line 921*a* that is one signal line of an earphone 910. Further, the central conductor 924 is connected with a signal line 921*b* that is the other signal line of the earphone 910, via a capacitor 960 that has a high impedance at a frequency band for an audio signal and has a low impedance at a frequency band for a high-frequency signal.

Further, the shield line 925 of the coaxial cable 926 is connected with the signal line 921*b* that is the other signal line of the earphone 910, via a high-frequency choke 916 that has a low impedance at a frequency band for an audio signal and has a high impedance at a frequency band for a high-frequency signal.

In the earphone antenna having the above structure, a capacitor and a high-frequency choke coil separate an audio signal from a high-frequency signal received by an antenna.

Because of recent speeding-up of digital circuits, noises from wireless communication terminal devices, such as clocks of CPUs and digital circuits, range from a low frequency to a high frequency. Specifically, the frequency range of noises is very wide, ranging from several 100 kHz to several GHz. These are noises to a received radio wave etc.

Noises directly emitted from the wireless communication terminal devices affect cables of antennas or affect the wireless communication terminal devices via audio signal cables.

Separating signals having noise components by use of capacitors and choke coils as described above is insufficient for preventing the affect of noises. The above conventional earphone antenna has a problem that it is greatly affected by electromagnetic wave noises from the wireless communication terminal device and as a result reception sensitivity of the antenna greatly drops.

The present invention was made to solve the foregoing problems. An object of the present invention is to provide a technique that allows more effectively avoiding the affect of electromagnetic wave noises from a wireless communication terminal device in an earphone antenna device (alternatively, an antenna device having a similar structure) compared with a conventional technique of using only a capacitor or a choke coil, thereby effectively increasing reception sensitivity of an antenna.

SUMMARY OF THE INVENTION

In order to solve the foregoing problems the inventors of the present invention diligently studied and found the followings: in the earphone antenna device, antennas having doubled as a pair of earphone cables in a conventional earphone antenna device are provided independently of the earphone cables, an audio signal cable is connected with the earphone cables, and an antenna coaxial cable is connected with the antennas. This allows the earphone antenna device to be less likely to be influenced by noises ranging from low frequencies to high frequencies from a wireless communication terminal device, and by noises transmitted via the audio signal cable. Further, this technique is applicable to an antenna device without the function of an earphone device. As a result, the inventors completed the present invention.

In order to solve the foregoing problems, the earphone antenna device of the present invention is an earphone antenna device, operable to be connected with a terminal device having a wireless communication function, made by integrating (i) an earphone device in which two earphone sections are provided at both sides, respectively, of a supporter, with (ii) an antenna device, the earphone antenna device including: two earphone cables, connected with the two earphone sections, respectively, for supplying audio signals to the earphone sections; and an audio common cable, one end of which is connected with the terminal device and the other end of which is connected with the two earphone cables, the earphone antenna device further including: a pair of antenna elements, extending from a center of the supporter toward the earphone sections, respectively, at both sides of the supporter, the antenna elements being insulated from the earphone cables and being provided along the supporter; and an antenna coaxial cable, one end of which is connected with the terminal device and the other end of which is connected with the antenna elements, the antenna coaxial cable being insulated from the audio common cable and being integrated with the audio common cable.

With the arrangement, the antenna elements are provided from a center of the supporter toward the earphone sections, respectively, at both sides of the supporter, the antenna elements being provided along the supporter. Further, the antenna coaxial cable connected with the antenna elements is integrated with the audio common cable connected with the two earphone cables, while the antenna coaxial cable being electrically insulated from the audio common cable.

Accordingly, the audio cable and the line for the antenna are provided separately. This allows suppressing the influence of electromagnetic wave noises from the wireless communication terminal device.

It is preferable to arrange the earphone antenna device of the present invention so that each of the antenna elements has a string-shape or a plate-shape.

With the arrangement, the antenna elements are formed in accordance with the shape of the supporter. When each of the antenna elements is a conductive plate whose width ranges from approximately 3 mm to 20 mm or a conductive line whose diameter is 1 mm or more, the antenna elements are more likely to have a gain and a band width suitable for an antenna.

It is preferable to arrange the earphone antenna device of the present invention so that the supporter has a supporter-length adjustment section for adjusting the length of the supporter.

With the arrangement, the size of the earphone antenna device can be adjusted and be fixed so as to be suitable for a user.

It is preferable to arrange the earphone antenna device of the present invention so that a spacer is provided in a space surrounded by the supporter and the earphone sections provided at both sides, respectively, of the supporter, the spacer being provided along the supporter.

With the arrangement, the spacer provides a space between the earphone antenna device and the user's head. This prevents the user's head from directly contacting with the antenna elements, which results in sufficient reception characteristics.

Further, it is preferable to arrange the earphone antenna device of the present invention so as to further include power supply means for supplying a power from the center of the supporter to the antenna elements.

With the arrangement, various antenna elements that require power supply, such as plate-shaped antenna elements, can be used. This provides an antenna capable of receiving signals with high sensitivity while being hardly influenced by a human body.

Further, it is preferable to arrange the earphone antenna device of the present invention so that the antenna coaxial cable includes a signal line and a ground line, and at least one of the signal line and the ground line is directly or indirectly connected with at least one of the antenna elements.

With the arrangement, the string-shaped antenna elements are connected with the terminal device via the antenna coaxial cable. Accordingly, it is possible to connect lines from the wireless communication terminal device that emits noises to the antenna elements while suppressing the influence of the noises.

Further, it is preferable to arrange the earphone antenna device of the present invention so as to further include an unbalanced-balanced converter (balun) between the antenna elements and the antenna coaxial cable, the signal line and the ground line of the antenna coaxial cable being connected with unbalanced terminals of the unbalanced-balanced converter, and the antenna elements being connected with balanced terminals of the unbalanced-balanced converter, so that the signal line and the ground line of the antenna coaxial cable are indirectly connected with the antenna elements.

With the arrangement, the antenna elements are connected with the antenna coaxial cable via the unbalanced-balanced converter (balun), and are connected with the terminal device via the antenna coaxial cable. Accordingly, it is possible to connect lines from the wireless communication terminal device that emits noises to the antenna elements while suppressing the influence of the noises.

Further, the balanced-unbalanced converter has a band-pass property and serves as a filter for preventing transmission of frequency components other than a frequency component with a targeted band to be transmitted. Accordingly, it is possible to suppress noises of low frequency components and high frequency components other than a band to be transmitted as a reception signal.

Further, it is preferable to arrange the earphone antenna device of the present invention so as to further include power supply means and reception signal amplification means, the power supply means supplying a power to the reception signal amplification means, and the reception signal amplification means amplifying reception signals supplied from the antenna elements and transmitting the amplified reception signals to the terminal device via the antenna coaxial cable.

With the arrangement, the reception signals supplied from the antenna elements are amplified at a position distant from the terminal device (wireless communication terminal device). Accordingly, noises from a noise source of the terminal device are not amplified by the reception signal amplifying means. Therefore, it is possible to suppress the influence of noises in a line extending from the wireless communication terminal device that emits noises to the antenna elements.

The reception signal amplifying means may amplify reception signals that are supplied from the antenna elements to the unbalanced-balanced converter and are output from its unbalanced terminals.

Further, it is preferable to arrange the earphone antenna device of the present invention so that the signal line of the antenna coaxial cable is directly connected with one of the antenna elements, and the ground line of the antenna coaxial cable is directly connected with the other of the antenna elements.

With the arrangement, the string-shaped antenna elements are connected with the terminal device via the antenna coaxial cable. Accordingly, it is possible to connect lines from the wireless communication terminal device that emits noises to the antenna elements while suppressing the influence of the noises.

Further, as the antenna elements are directly connected with the antenna coaxial cable, the balanced-unbalanced converter is unnecessary, which reduces costs.

Further, it is preferable to arrange the earphone antenna device of the present invention so that each of the earphone cables includes a signal line and a ground line, and the ground line of each earphone cable is connected with a ground line of the antenna coaxial cable via a high-frequency choke coil, so that a ground line of each of the antenna elements doubles as a ground line of each of the earphone sections.

With the arrangement, the ground line of the earphone cable is connected with the ground line of the antenna element via a high-frequency choke coil for suppressing transmission of a high-frequency signal, so that the ground line of the antenna element doubles as the ground line of the earphone section. This simplifies wirings and thus reduces costs.

Further, it is preferable to arrange the earphone antenna device of the present invention so that the antenna coaxial cable and the audio common cable integrated with each other have an end to be connected with the terminal device, and the end is provided with one or more connecting terminals. The connecting terminals may be provided for the audio common cable and the antenna coaxial cable, respectively. Alternatively, the connecting terminal is a multipolar connector connected with both of the audio common cable and the antenna coaxial cable.

With the arrangement, the audio common cable and the antenna coaxial cable have a common connecting terminal or respective connecting terminals, and therefore can be connected with various wireless communication terminal devices. The wireless communication terminal device may be a device that performs wireless communications by use of a detachable wireless communication module.

When a connecting terminal between the audio common cable and the terminal device and a connecting terminal between the antenna coaxial cable and the terminal device are provided separately, wirings for an audio signal and a reception signal are different at the connecting terminals. Accordingly, it is unnecessary to separate a waveband for an audio signal from a waveband for a reception signal. In particular, base band noises included in an audio signal from the wireless communication terminal device are hardly transmitted.

When a connecting terminal between: the audio common cable and the antenna coaxial cable; and the terminal device is a multipolar connector that is connected with both of the audio common cable and the antenna coaxial cable, a user can connect the earphone antenna device with the wireless communication terminal device only by a single attachment of the connector, which is convenient.

Further, the earphone antenna device of the present invention may be arranged so that the antenna elements are contained in a coating insulator whose external shape allows the coating insulator to be attached to any object while the antenna elements being provided independently of the earphone cables. In this case, the coating insulator has a strap-shape.

With the arrangement, the shape of the insulator allows the earphone antenna device to be attached to any object or semi-fixed so that the earphone antenna device is easy to use. Further, when the insulator has a strap-shape, the earphone antenna device is easily hung at the object or the neck of a human body.

In order to solve the foregoing problems, the wireless communication terminal device of the present invention is connected with the earphone antenna device or the dipole antenna device.

With the arrangement, an antenna connected with the wireless communication terminal device is the earphone antenna device or the dipole antenna device. Accordingly, it is possible to provide a wireless communication terminal device having excellent reception characteristics with little influence of noises from the wireless communication terminal device.

Further, the wireless communication terminal device of the present invention may be portable. When the wireless communication terminal device is connected with the earphone antenna device or the dipole antenna device, it is possible to carry the wireless communication terminal device having excellent reception characteristics with little influence of noises from the wireless communication terminal device.

For a fuller understanding of the nature and advantages of the invention, reference should be made to the ensuing detailed description taken in conjunction with the accompanying drawings.

DESCRIPTION OF THE EMBODIMENTS

Embodiment 1

The following explains an embodiment of the present invention with reference to FIGS. 1 to 9.

Figure 2:
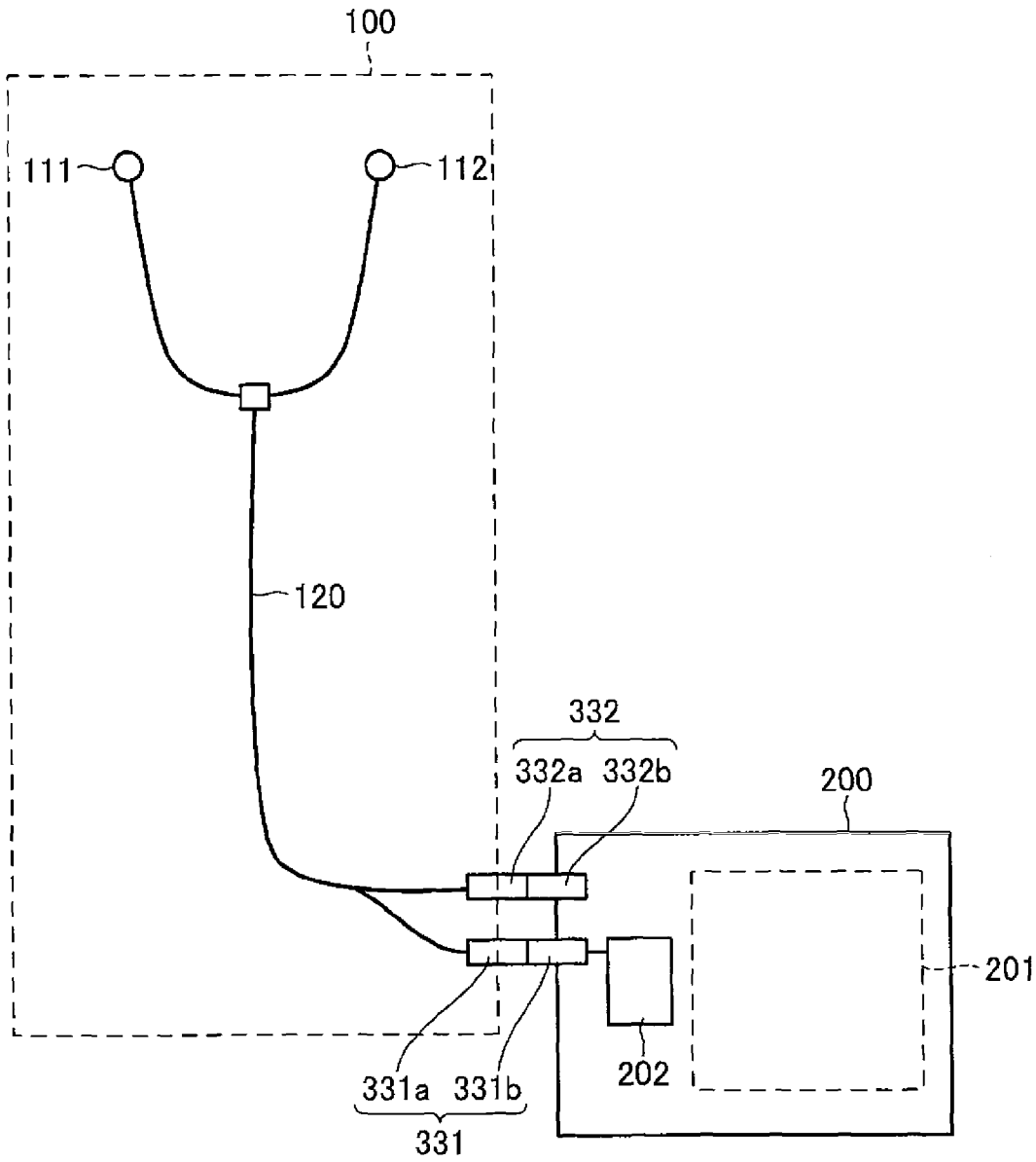
FIG. 2 is a drawing for embodiments of an earphone antenna device and a wireless communication terminal device of the present invention.

FIG. 2 is a drawing for illustrating an earphone antenna device 100 and a wireless communication terminal device 200 in the present embodiment.

The earphone antenna device 100 includes earphone sections 111 and 112 and a cable 120. An example of the wireless communication terminal device 200 is a portable TV.

In the present embodiment, an explanation will be made as to a case where the wireless communication terminal device 200 is a portable TV. However, the wireless communication terminal device 200 is not limited to this. The wireless communication terminal device used in the present invention may be anything as long as it has a wireless communication function, and may preferably be a terminal device etc. that receives airwaves other than those of TVs. Further, the wireless communication terminal device 200 is not limited to a portable terminal device, and may be a so-called stationary terminal device (such as a stationary-type TV).

The wireless communication terminal device 200 includes a display 201 and a TV tuner 202.

Figure 3:
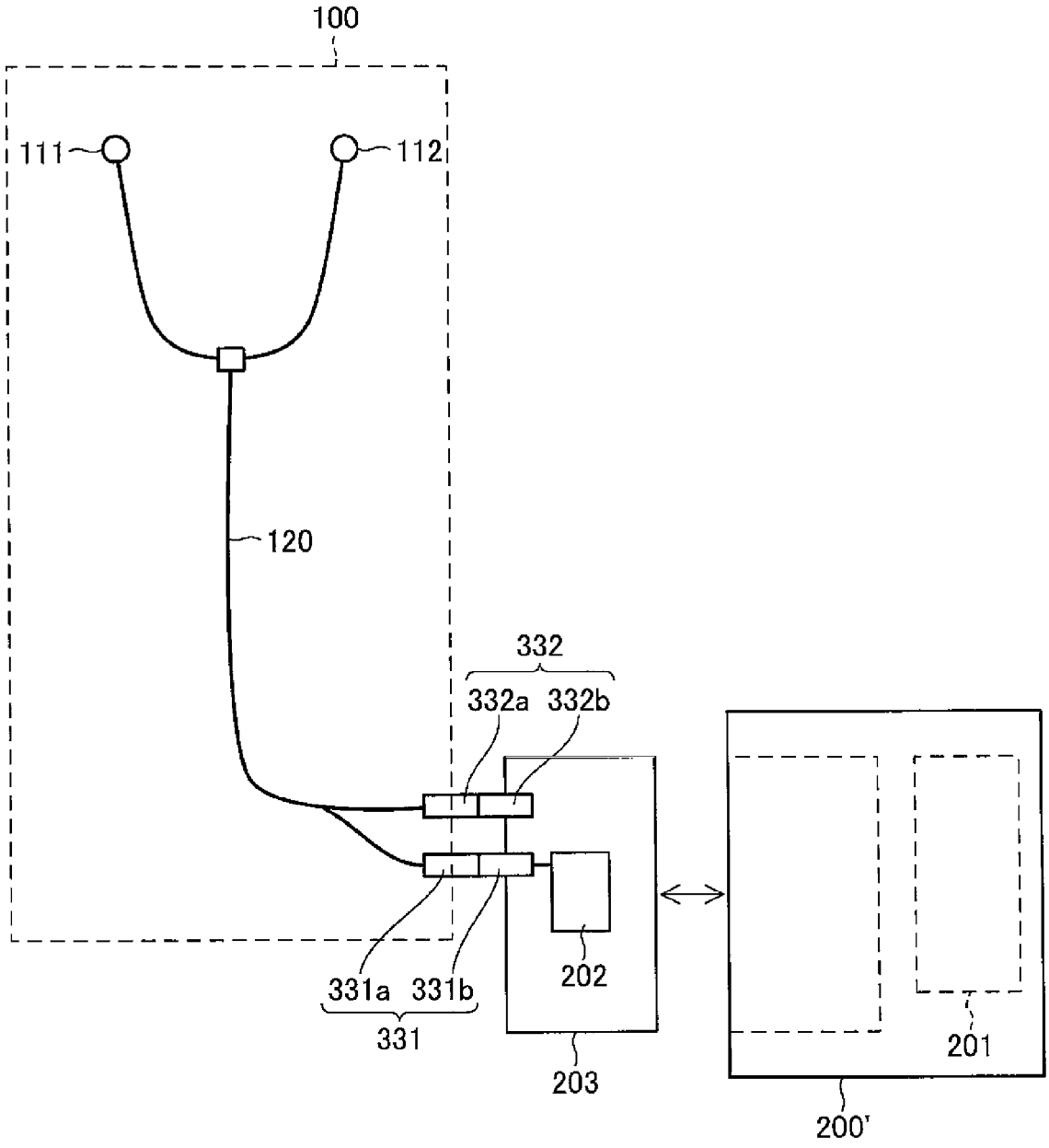
FIG. 3 is a drawing for illustrating another embodiments of an earphone antenna device and a wireless communication terminal device of the present invention, the wireless communication terminal device being configured such that a wireless communication module including a wireless communication function of the wireless communication terminal device in FIG. 2 can be attached to/detached from the wireless communication terminal device.

Further, as illustrated in FIG. 3, a detachable wireless communication module 203 may perform wireless communications. The wireless communication module 203 includes a wireless communication function such as the TV tuner 202, and is capable of being attached to/detached from a terminal device 200' including a display device such as the display 201. With the arrangement, for example, by attaching the wireless communication module 203 to the terminal device 200' without a wireless communication function, the terminal device 200' can perform wireless communications Connection between the wireless communication module 203 and the terminal device 200' may be performed via a conventional connection such as a USB connection or may be performed in such a manner that the wireless communication module 203 is connected to a connection bus of the terminal device 200', e.g. an expansion slot of a portable terminal device.

The earphone antenna device 100 includes an antenna terminal 331*a* and an earphone terminal 332*a* at an end of the cable 120. The wireless communication terminal device 200 includes plug terminals 331*b* and 332*b*. The antenna (RF) terminal 331*a* and the earphone terminal 332*a* of the earphone antenna device 100 are connected with the plug terminals 331*b* and 332*b*, respectively, of the wireless communication terminal device 200.

In the present embodiment, the antenna terminal 331*a* and the earphone terminal 332*a* are provided separately.

Figure 1:
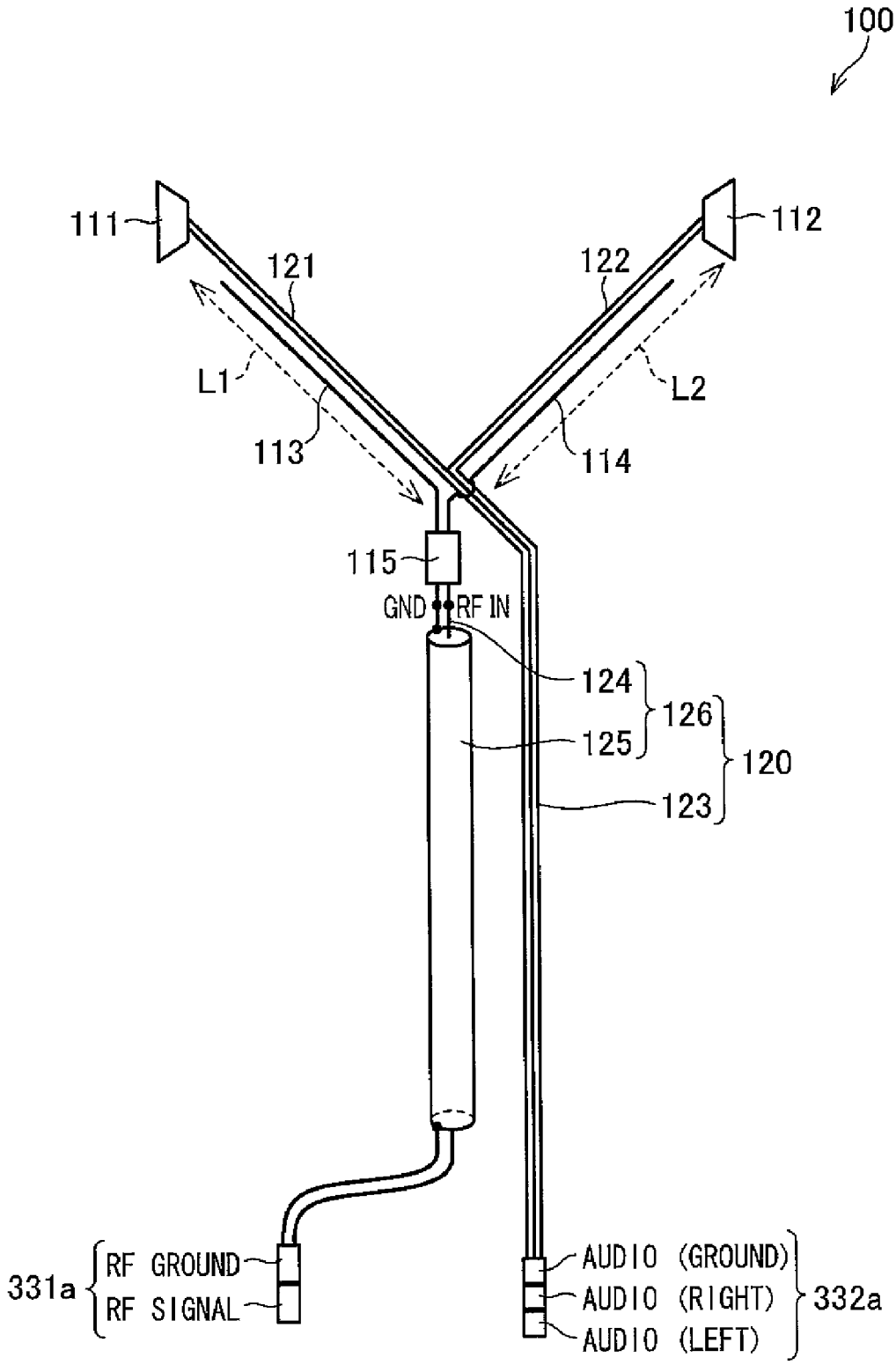
FIG. 1 is a drawing for illustrating an embodiment of an earphone antenna device of the present invention.

The following explains a structure of the earphone antenna device 100 with reference to FIG. 1.

The earphone sections 111 and 112 that are provided at the left side and the right side, respectively, are electrically connected with the earphone terminal 332*a* via audio cables 121 and 122 that transmit audio signals. Further, there are provided a first antenna element 113 and a second antenna element 114 that extend along the audio cables 121 and 122, respectively (for convenience of explanation, the first antenna element 113 and the second antenna element 114 may be hereinafter referred to as "antenna element 113" and "antenna element 114", respectively).

When each of the antenna elements is a conductive line whose diameter is 1 mm or more for example, the antenna elements are likely to have gain and band width suitable for an antenna.

One ends of the antenna elements 113 and 114 are provided along the audio cables 121 and 122, respectively, and the other ends of the antenna elements 113 and 114 are connected with balanced terminals of a balanced-unbalanced converter 115.

At unbalanced terminals of the balanced-unbalanced converter 115, a signal output is connected with a signal line 124 of the coaxial cable 126 and a ground output is connected with a ground line 125 of the coaxial cable 126.

Signals received by the antenna elements 113 and 114 are converted by the balanced-unbalanced converter 115 into signals in an unbalanced mode. The signals are transmitted from the balanced-unbalanced converter 115 to the antenna terminal 331*a* via the coaxial cable.

On the other hand, ground lines of the audio cable 121 at the left side and the audio cable 122 at the right side are electrically connected with each other at the balanced-unbalanced converter 115 so as to be a common ground line that is connected with the earphone terminal 332*a*. An audio cable 123 includes three cables: a right audio signal line, a left audio signal line, and the common ground line.

Further, the antenna elements 113 and 114 and the audio cables 121 and 122 are individually covered with insulators. Further, the antenna element 113 and the audio cable 121 are integrally covered with an insulator, and the antenna element 114 and the audio cable 122 are integrally covered with an insulator.

Further, the coaxial cable 126 including the balanced-unbalanced converter 115, and the audio cable 123 that transmits audio signals, are individually covered with insulators, and the coaxial cable 126 and the audio cable 123 thus covered are integrally covered with an insulator. Thus, these cables are integrated and appear to be one cable that is the cable 120.

The lengths of the antenna elements 113 and 114 are determined by operation areas of the antennas.

The lengths may be suitably determined according to center frequency etc. of a radio wave band in use.

When the operation area of the antenna corresponds to UHF band, specifically 470 MHz to 600 MHz for TV broadcasting, lengths L1 and L2 of the antenna elements 113 and 114, respectively, are approximately ¼ of a wavelength, i.e. approximately 15 cm. the antenna elements 113 and 114 are made of conductive lines with the above length that extend from a point where the audio cables 121 and 122 diverge toward the earphone sections 111 and 112.

Further, when the operation area of the antenna corresponds to VHF band, specifically 250 MHz or so, the lengths L1 and L2 of the antenna elements 113 and 114, respectively, are approximately ¼ of a wavelength, i.e. approximately 30 cm. At that time, the antenna elements 113 and 114 are made of conductive lines with the above length that extend from a point where the audio cables 121 and 122 diverge toward the earphone sections 111 and 112.

Further, when the operation area of the antenna corresponds to FM broadcasting band, the lengths L1 and L2 of the antenna elements 113 and 114, respectively, are approximately ¼ of a wavelength, i.e. approximately 80 cm. At that time, the antenna elements 113 and 114 are made of conductive lines with the above length that extend from a point where the audio cables 121 and 122 diverge toward the earphone sections 111 and 112.

At that time, the present embodiment may be arranged so that at least one of the earphone sections 111 and 112 is made of a conductor such as an aluminum plate and the antenna elements 113 and 114 are formed to include the earphone sections 111 and 112, respectively.

Figure 4:
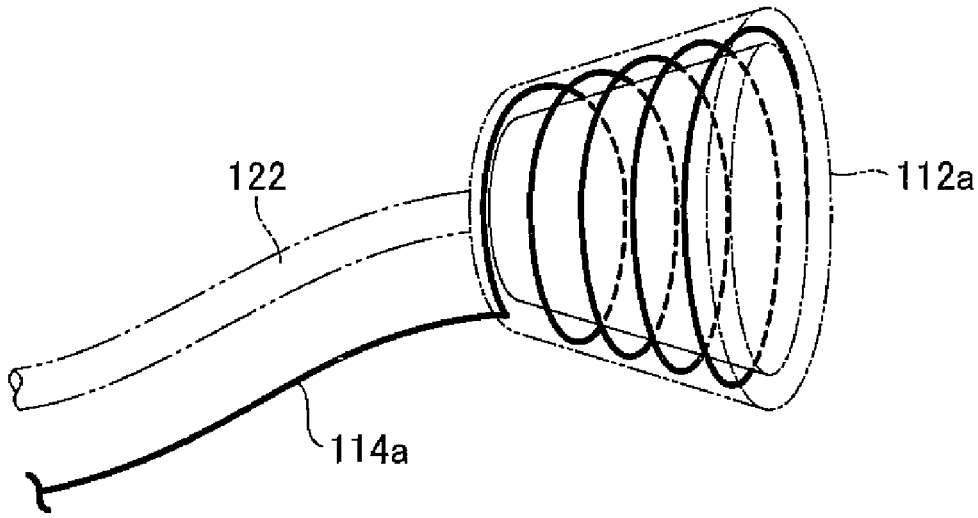
FIG. 4 is a drawing for illustrating another embodiment of an earphone antenna device of the present invention, illustrating another shape of an earphone section of the earphone antenna device of FIG. 1.

As shown in FIG. 4, the present embodiment may be arranged so that a line made of an antenna element with a spiral shape is provided in each of the earphone sections so that the lengths L1 and L2 of the antenna elements are longer. FIG. 4 illustrates a configuration in which an antenna element 114*a* with a spiral shape is provided in an earphone section 112*a*. In this case, the antenna element 114*a* is formed in the earphone section 112*a* through patterning by use of a metal line so that the antenna element 114*a* is formed with high exactness and high reproducibility.

In the above embodiment, the antenna terminal 331*a* for antenna (RF) connection and the earphone terminal 332*a* for an audio signal output are provided separately.

The following explains a function of the earphone antenna device 100 of the present embodiment with reference to FIG. 1.

In the earphone antenna device 100, the antenna element 113 and the antenna element 114 constitute a dipole antenna. Signals received by the antenna elements 113 and 114 are balanced signals, and converted by the balanced-unbalanced converter 115 into RF signals in a coaxial mode (unbalanced signals). The RF signals are transmitted via the coaxial cable 126 and transmitted via a connector 331 with which the antenna terminal 331*a* and the plug terminal 331*b* are connected, and the RF signals are supplied to the TV tuner 202 of the wireless communication terminal device 200.

Further, the balanced-unbalanced converter 115 has a band-pass property and serves as a filter for preventing transmission of frequency components other than a frequency component with a targeted band to be transmitted.

Specific examples of the balanced-unbalanced converter 115 include: a bridge-type and a ladder-type converter made of an LC circuit; and a converter that is a transformer made of a coiled ferritic core.

A known example of the balanced-unbalanced converter of a bridge-type or a ladder-type made of an LC circuit is a converter having a band-pass property that is a narrow band property, i.e. approximately 450 MHz to 700 Mhz. A known example of the balanced-unbalanced converter that is a transformer made of a coiled ferritic core is a converter whose transmission property is approximately 100 MHz to 1 GHz.

Noises from the wireless communication terminal device 200 are caused by clock components etc. from a digital circuit. Such noises are in a range of several 10 MHz and accordingly can be attenuated by any one of the above balanced-unbalanced converters.

Further, by attenuating the noises of several 10 MHz, it is possible to reduce noises outside a reception band that are recombined with the wireless communication terminal device 200. That is, it is possible to attenuate: fundamental waves of noises generated by the digital circuit of the wireless communication terminal device 200; and harmonic wave components caused by a nonlinear operation. As a result, it is possible to suppress noises in the operation area of the antenna.

Further, it is known that common-mode noises are dominant out of noises from the wireless communication terminal device 200. Consequently, in the case of using the balanced-unbalanced converter, a signal line and a ground line from an unbalanced circuit (antenna circuit at the side of the wireless communication terminal device 200) are likely to be combined with noise components with the same phase. However, a balanced circuit (antenna power supply section) performs distribution of opposite phase, and accordingly cancellation of phases occurs. This allows suppression of the noises combined with the signal line and the ground line.

Therefore, the balanced-unbalanced converter 115 of the present embodiment can attenuate noises that are low frequency components and high frequency components other than a band to be transmitted as a reception signal.

As with a well-known TV receiver, the TV tuner 202 selects a reception signal supplied via a channel selected by a user, modulates the signal, and generates a base band signal. A TV reception signal and an audio signal are extracted through a digital signal process from the base band signal, and are output from the display 201 and a speaker that are provided in the wireless communication terminal device 200.

Further, the TV reception signal may be output from the wireless communication terminal device 200 and be displayed by an external display device. The audio signal may be output from the wireless communication terminal device 200 and be reproduced.

The audio signal is output from the plug terminal 332*b* in the wireless communication terminal device 200 via a connector 332, transmitted via the audio cables 121 and 122, and is output from the earphone sections 111 and 112 at the left side and the right side, respectively.

In a conventional earphone antenna device, the same line serves as both a line for an audio cable and a line for an antenna. Consequently, a noise from the wireless communication terminal device (e.g. a noise from a digital circuit) is mixed with an audio output of the wireless communication terminal device, is transmitted via the audio cable, and disturbs an antenna element included in the antenna.

Further, some conventional earphone antenna devises are provided with a mechanism for separating a noise component signal by use of a capacitor or a choke coil in order to suppress the influence of the noise. However, with the mechanism, the noise cannot be separated sufficiently. That is, the conventional earphone antenna is greatly affected by an electromagnetic wave noise from a wireless communication terminal device, which deteriorates reception sensitivity of the antenna.

In the earphone antenna device 100 of the present embodiment, the antenna elements 113 and 114 and the coaxial cable 126 (including a ground terminal) that transmit reception signals are separated by an insulator from the audio cable 123 that transmits audio signals. The antenna elements 113 and 114 and the coaxial cable 126 function as an electric circuit made of lines independent from a line of the audio cable 123, and the audio cable 123 functions as an electric circuit made of a line independent from lines of the antenna elements 113 and 114 and the coaxial cable 126.

Consequently, low frequency noises and high frequency noises from the wireless communication terminal device 200 that are transmitted via the plug terminal 332*b* of the wireless communication terminal device 200 are hardly combined with the coaxial cable 126 that constitutes the antenna.

Further, in the line for an antenna, a cable from the wireless communication terminal device 200 to the balanced-unbalanced converter 115 is made of the coaxial cable 126. This allows the antenna circuit to be provided with a distance from the wireless communication terminal device 200 that emits noises. This allows the antenna circuit to be free from the influence of the noises. A noise from the wireless communication terminal device 200 is a near-field electromagnetic wave in consideration of its frequency component (up to 3 GHz). Therefore, the size of the noise is inversely proportional to square and cubic of a distance from the wireless communication terminal device 200. Accordingly, keeping the antenna circuit away from the wireless communication terminal device 200 is effective for reducing noises.

In the present embodiment, the earphone antenna device 100 may be held by a user so that the antenna section is worn at the user's neck, and the wireless communication terminal device 200 may be held by a hand near user's belly or user's knee. When the earphone antenna device 100 and the wireless communication terminal device 200 are held as described above, a distance between the wireless communication terminal device 200 and the antenna elements 113 and 114 is several 10 cm or more via the coaxial cable.

Consequently, by keeping the antenna circuit away from the wireless communication terminal device 200 as described above, it is possible to reduce the influence of noises.

In addition, as the wireless communication terminal device 200 is held by hands and the user's body exists near the wireless communication terminal device 200 and the antenna elements 113 and 114, the hands and the human body absorb the noises from the wireless communication terminal device 200.

It is preferable that low path filter means for cutting a high frequency signal of 100 MHz or more that is a frequency for TV broadcasting is provided at a point prior to the plug terminal 332*b* that outputs an audio signal of the wireless communication terminal device 200. The low path filter means prevents noises derived from the wireless communication terminal device 200 from being transmitted to the audio cable 123, and thus further prevents noises from being combined with the antenna elements 113 and 114 and the coaxial cable 126.

In the wireless communication terminal device 200 of the present embodiment, it is preferable that a ground line for an audio signal and a ground line for an antenna are provided separately.

Figure 5:
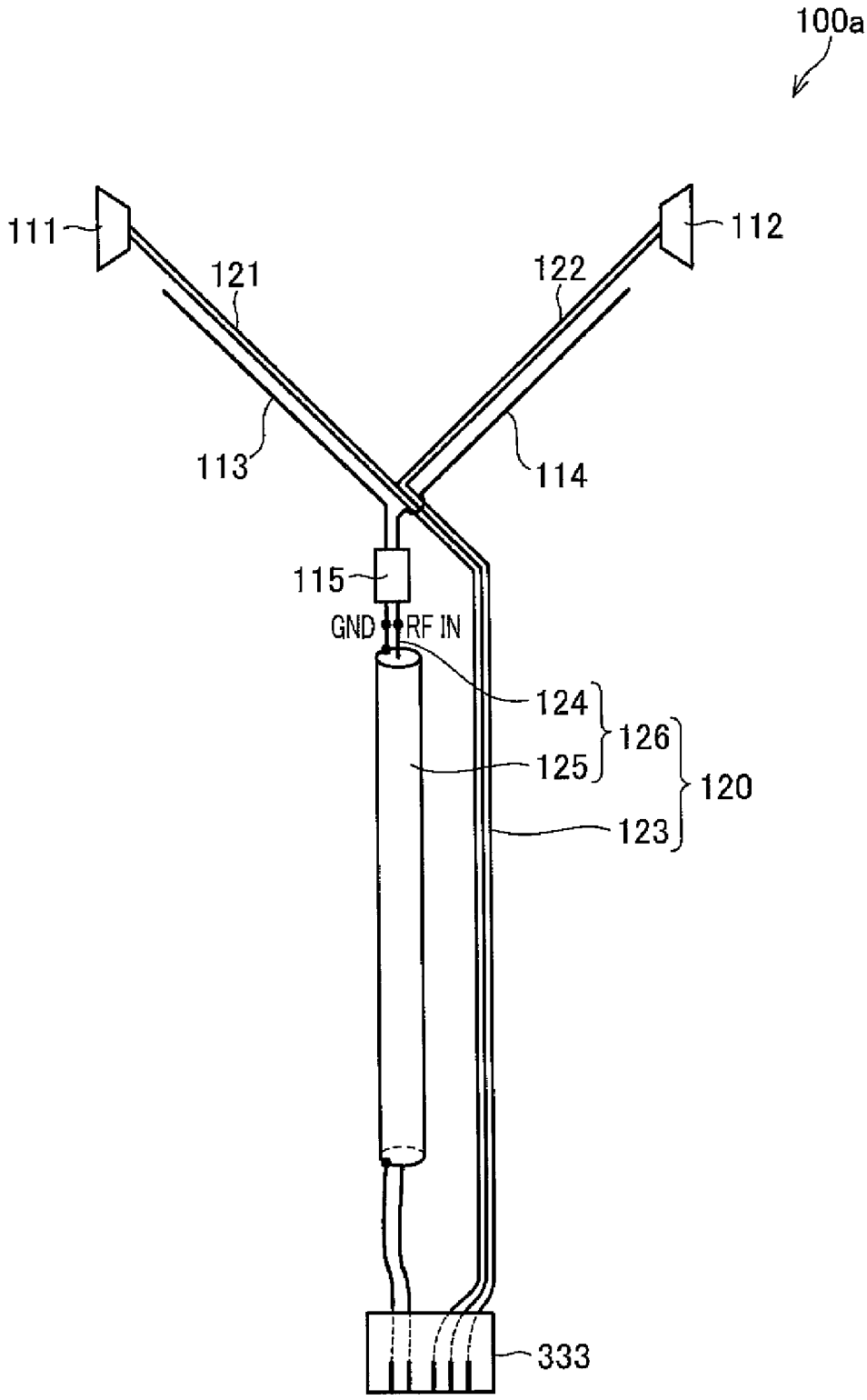
FIG. 5 is a drawing for illustrating another embodiment of an earphone antenna device of the present invention, illustrating a modification example of a connector portion of the earphone antenna device of FIG. 1.

Further, the present embodiment may be arranged so that the antenna terminal 331*a* and the earphone terminal 332*a* of the earphone antenna device 100 are integrated to be a multi-pin connector 333 in an earphone antenna device 100*a* illustrated in FIG. 5, and the plug terminals 331*b* and 332*b* of the wireless communication terminal device 200 are integrated to be a multi-pin connector (not shown) whose shape corresponds to that of the multi-pin connector 333.

When connection terminals are integrated to be a multi-pin connector as in the case of the earphone antenna device 100*a*, it is unnecessary to separately provide the antenna terminal 331*a* and the earphone terminal 332*a*, and a user can connect the earphone antenna device 100*a* with the wireless communication terminal device 200 only by a single attachment of the connector, which is more convenient.

Figure 6:
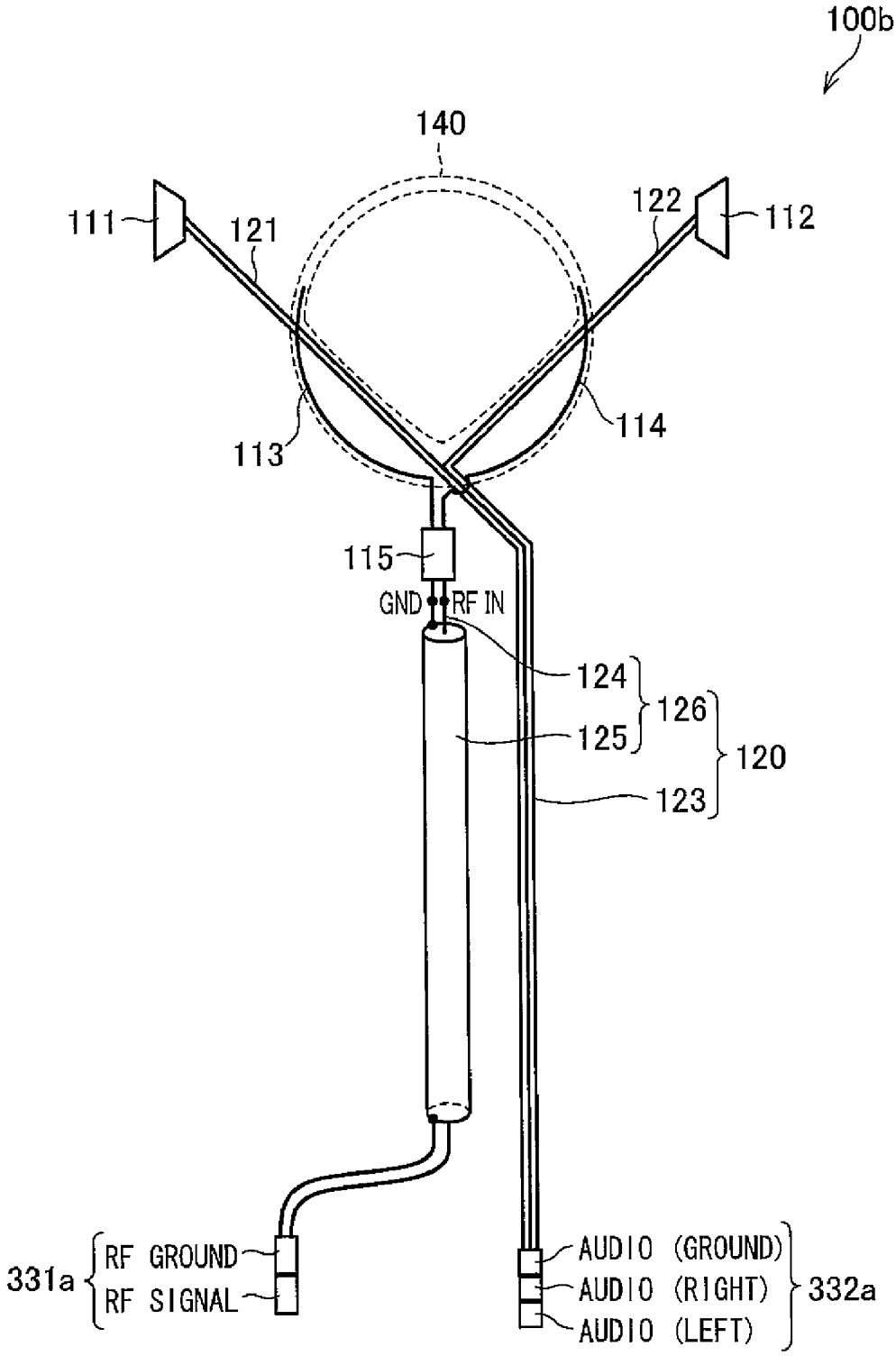
FIG. 6 is a drawing for illustrating another embodiment of an earphone antenna device of the present invention, illustrating a modification example of a supporter to support the earphone antenna device of FIG. 1.

Further, the present embodiment may be arranged so that insulators for the audio cables 121 and 122 to transmit left audio and right audio, respectively, diverge to form a loop-shaped insulating section 140 in an earphone antenna device 100*b* illustrated in FIG. 6. Further, the present embodiment may be arranged so that the insulators diverge to form a string-shaped insulating section 141 in an earphone antenna device 100*b*' illustrated in FIG. 7.

The insulating sections 140 and 141 allow the earphone antenna devices 100*b* and 100*b*', respectively, of the present embodiment to be easily worn at a user's neck or to be semi-fixed so that the earphone antenna devices 100*b* and 100*b*' are easy to use.

In the earphone antenna devices 100*b* and 100*b*', too, the antenna elements 113 and 114 are provided separately.

In the earphone antenna devices 100*b* and 100*b*', the insulating sections 140 and 141 have a loop-shape and a string-shape, respectively. Accordingly, the antenna elements 113 and 114 may be formed to have a loop-shape or a string-shape provided in the insulating section 140 or the insulating section 141.

As described above, in the present embodiment, the antenna elements 113 and 114 may be integrated with the audio cables 121 and 122, respectively, or the antenna elements 113 and 114 may be provided independently of the audio cables 121 and 122, respectively. In the latter case, the insulating sections 140 or 141 for covering the antenna elements 113 and 114 is not particularly limited in terms of its specific shape, and may have a suitable shape according to the use application of the earphone antenna device 100*b* or 100*b*'.

In particular, in the case of using a portable terminal device as the wireless communication terminal device 200 as in the present embodiment, the insulating section may have a strap-shape such as a loop-shape allowing a user to wear it around the user's neck, so that the user can more easily wear the earphone antenna device 100*b*. Further, the insulating section may have other publicly known shape allowing the user to wear it at a portion other than a neck. In addition to the case of the user wearing the earphone antenna device 100*b*, the insulating section may have a shape allowing it to be attached to any object.

As described above, in the present invention, the antenna elements 113 and 114 may be provided independently of the earphone cables and be included in a coating insulator whose external shape allows the coating insulator to be attached to any object (including a user and other objects).

Further, the present invention may be arranged so that one of the antenna elements 113 and 114 is connected with the signal line 124 of the coaxial cable 126 and the other is connected with the ground line 125 of the coaxial cable 126 without intervention of the balanced-unbalanced converter 115.

Figure 8:
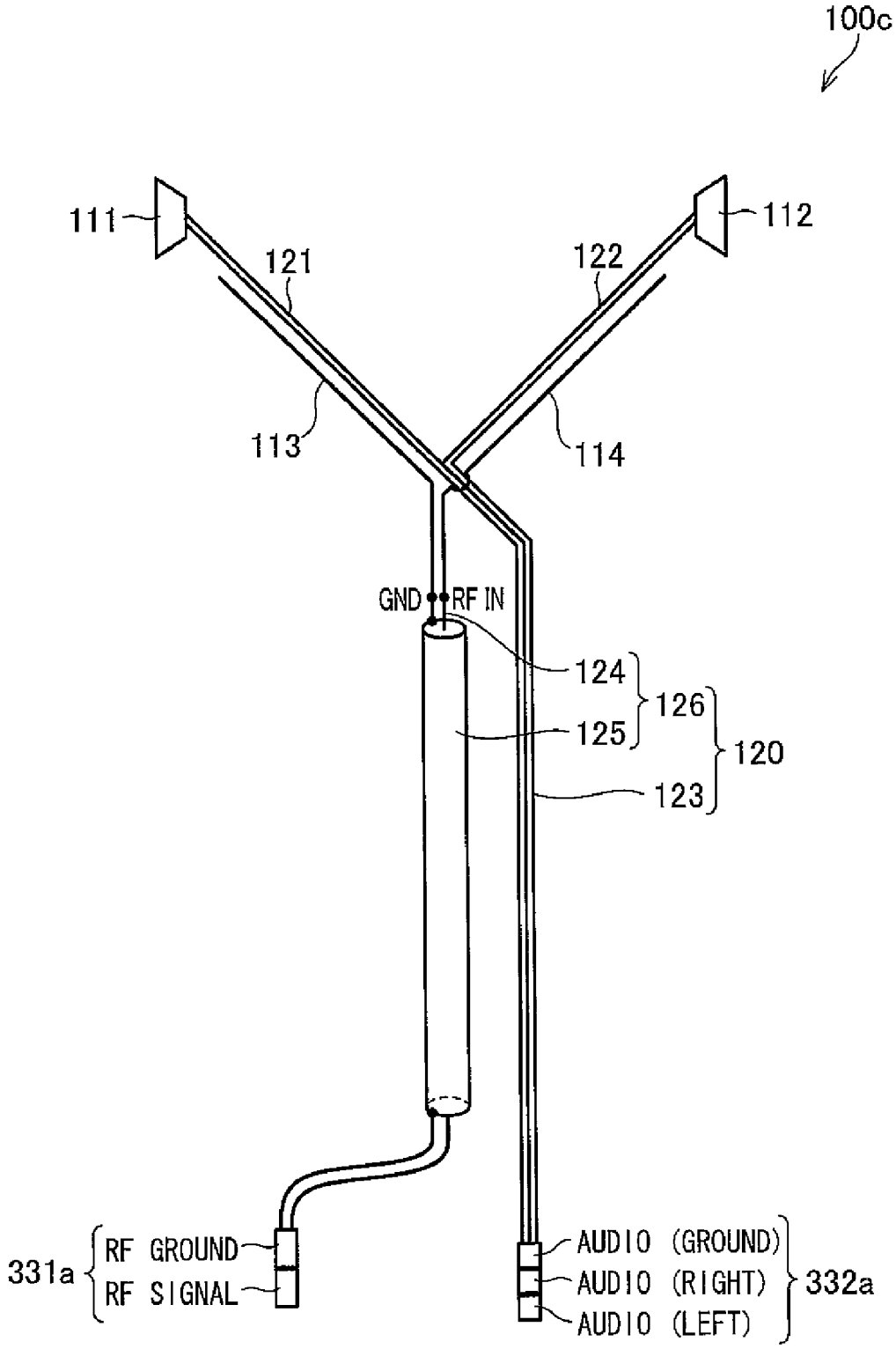
FIG. 8 is a drawing for illustrating another embodiment of an earphone antenna device of the present invention, illustrating a modification example of how to connect the antenna element of FIG. 1.
Figure 9:
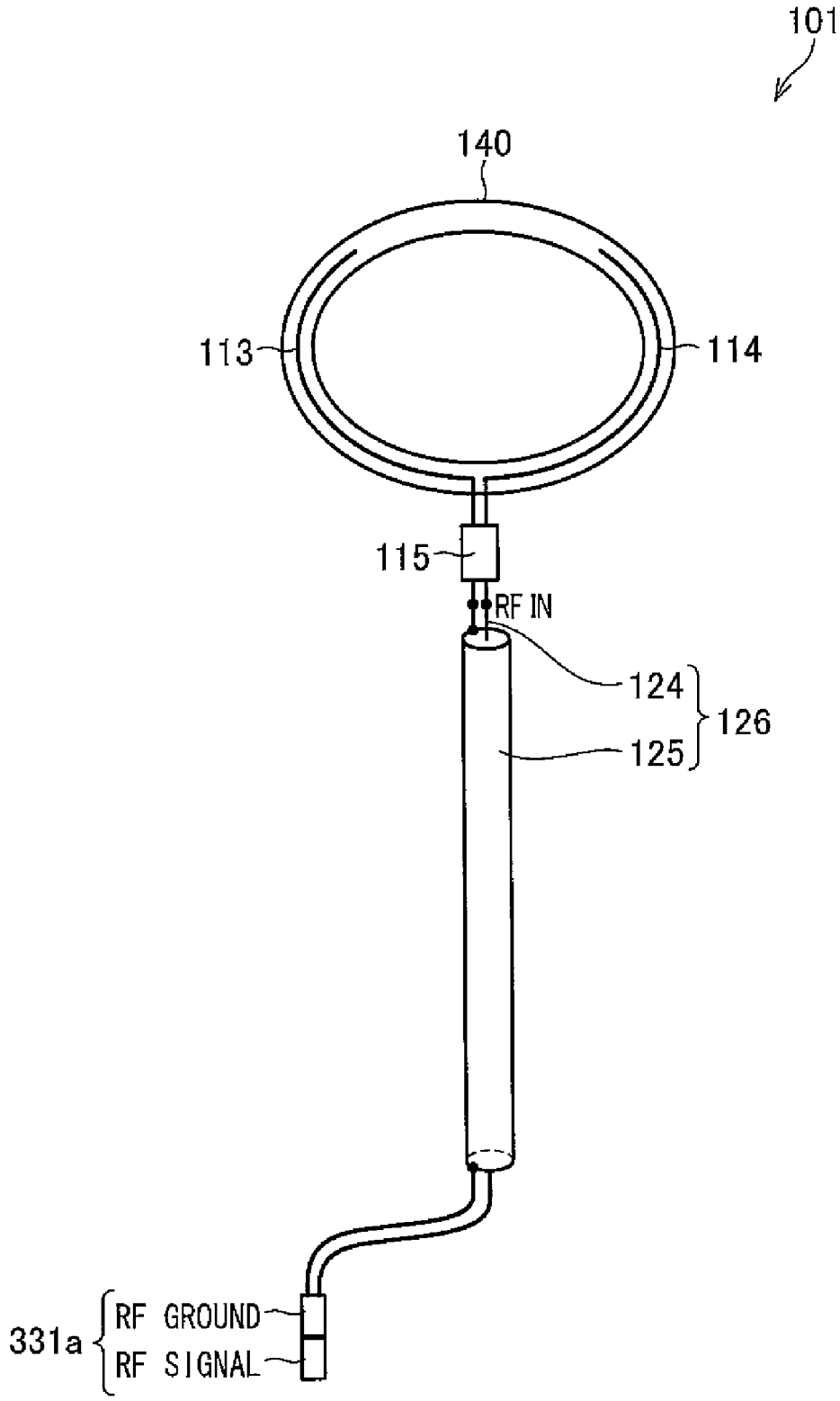
FIG. 9 is a drawing for illustrating an embodiment of an antenna device of the present invention.

FIG. 8 illustrates an earphone antenna device 100*c* obtained by changing the earphone antenna device 100 so that the balanced-unbalanced converter 115 is removed and the first antenna element 113 is connected with the ground line 125 and the second antenna element 114 is connected with the signal line 124.

The antenna has a substantially symmetrical structure as illustrated in FIG. 8. Therefore, the first antenna element 113 may be connected with the signal line 124 and the second antenna element 114 may be connected with the ground line 125.

Figure 7:
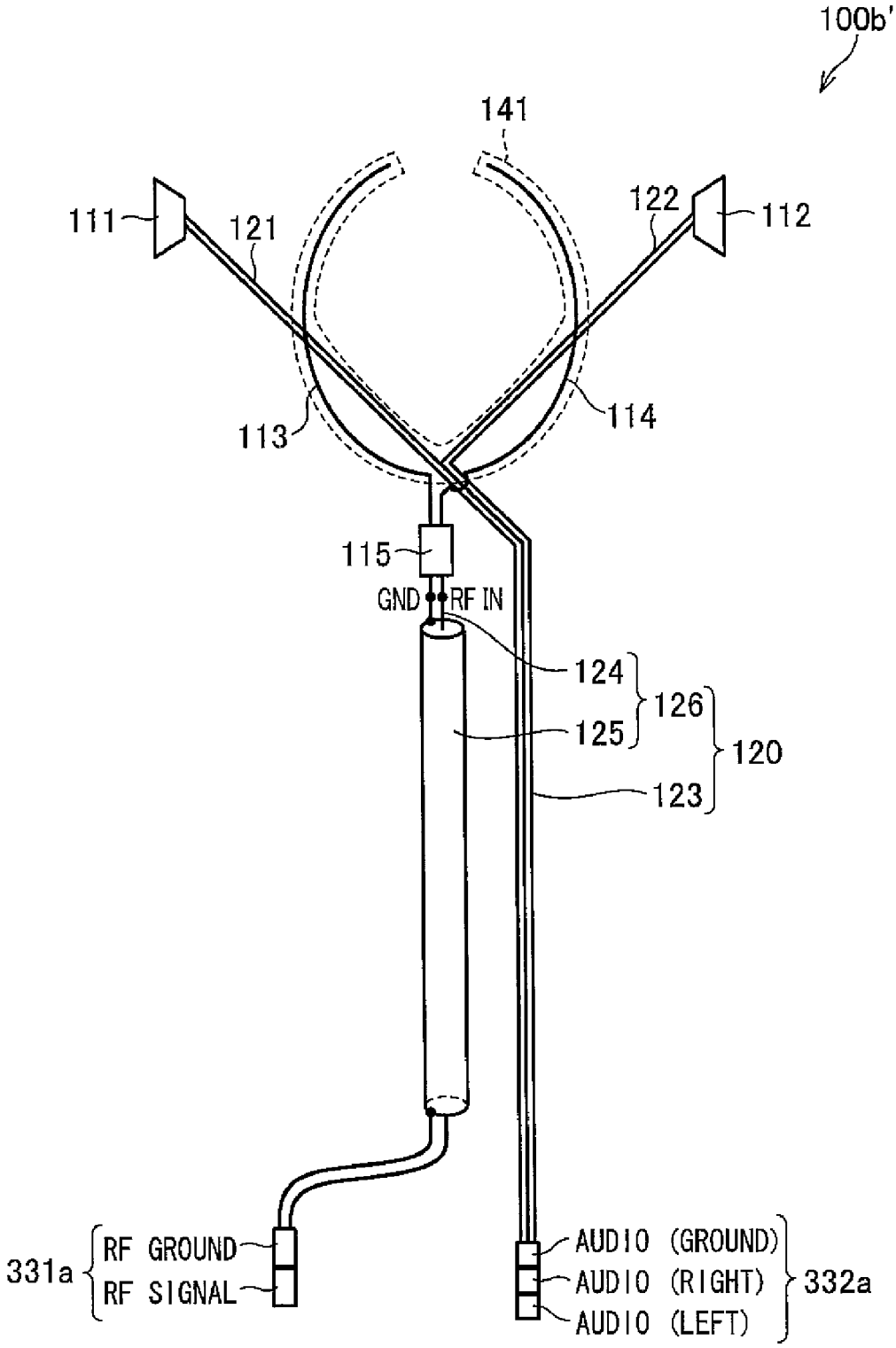
FIG. 7 is a drawing for illustrating another embodiment of an earphone antenna device of the present invention, illustrating another modification example of a supporter to support the earphone antenna device of FIG. 1.

Further, the antenna may include the multi-pin connector 333 as illustrated in FIG. 5, and may include the loop-shaped insulating section 140 illustrated in FIG. 6 or the string-shaped insulating section 141 illustrated in FIG. 7.

The earphone antenna device 100*c* with the above structure can function as an antenna. Further, as the earphone antenna device 100*c* does not require the balanced-unbalanced converter 115, the earphone antenna device 100*c* has a simpler structure, which reduces costs.

In other words, the earphone antenna device of the present invention does not necessarily require the balanced-unbalanced converter 115 as long as at least one of the first antenna element 113 and the second antenna element 114 is connected with at least one of the signal line 124 and the ground line 125 of the coaxial cable 126 so that the earphone antenna device functions as an antenna.

Therefore, in the present invention, as illustrated in FIG. 1 etc., the earphone antenna device 100 including the balanced-unbalanced converter 115 may be such that the signal line 124 and the ground line 125 of the coaxial cable 126 are indirectly connected with the first antenna element 113 and the second antenna element 114 via the balanced-unbalanced converter 115. Alternatively, in the present invention, as illustrated in FIG. 8, the earphone antenna device may be such that the signal line 124 of the coaxial cable 126 is directly connected with at least one of the first antenna element 113 and the second antenna element 114 and the ground line 125 is directly connected with the other of the first antenna element 113 and the second antenna element 114.

As described above, in the present embodiment, an explanation was made as to the earphone antenna device including both earphones and antennas. Alternatively, the present embodiment may be arranged so that the earphone sections 111 and 112 and the audio cables 121 and 122 for transmission of audio are removed to obtain an antenna device 101 with a string shape that allows a user to wear the antenna device 101 around the user's neck.

Embodiment 2

The following explains another embodiment of the present invention with reference to FIGS. 10 to 13.

Structures other than structures explained in the present embodiment are the same as those in Embodiment 1. For convenience of explanation, members having the same functions as those in drawings of Embodiment 1 are given the same reference signs and explanations thereof will be omitted here.

A headphone antenna device 400 of the present embodiment is a modification example of an earphone antenna device, and has a structure in which earphones at the left side and right side of the earphone antenna device are fixed by supporters. That is, in the headphone antenna device 400 of the present embodiment, a left earphone section 411 is connected with a left earphone supporter 441, a right earphone section 412 is connected with a right earphone supporter 442, and the left earphone supporter 441 and the right earphone supporter 442 are connected with each other so as to form a headphone section of the headphone antenna device 400. The earphone sections 411 and 412 may have a shape allowing them to be inserted into ear holes, or may have a shape allowing them to be pressed by the earphone supporters 441 and 442 to user's ears and fixed.

The left earphone supporter 441 and the right earphone supporter 442 may be made of any material as long as the left earphone supporter 441 and the right earphone supporter 442 can fix the left earphone section 411 and the right earphone section 412 to positions of ears. Examples of the material include plastic resin and metal. Further, the headphone antenna device 400 of the present embodiment may be arranged so that, through a well-known method, a supporter-length adjustment section 444 is provided at a connecting section between the left earphone supporter 441 and the right earphone supporter 442 or provided between the earphone supporter 441 and the corresponding earphone section 411 and between the earphone supporter 442 and the corresponding earphone section 412. The supporter-length adjustment section 444 can adjust the size of the headphone antenna device 400, allowing the headphone antenna device 400 to be fixed to a position suitable for the user.

Further, the headphone antenna device 400 of the present embodiment is used while being connected with the wireless communication terminal device 200 as with Embodiment 1. In the present embodiment, too, an explanation will be made as to a case where the wireless communication terminal device 200 is a portable TV. However, as with Embodiment 1, the wireless communication terminal device 200 is not limited to the portable TV and may be any terminal device as long as it has a wireless communication function.

The headphone antenna device 400 of the present embodiment includes an antenna terminal 431*a* and an earphone terminal 432*a* at an end of a cable 420. The antenna terminal 431*a* and the earphone terminal 432*a* correspond to the antenna terminal 331*a* and the earphone terminal 332*a*, respectively, of Embodiment 1, and are connected with plug terminals 331*b* and 332*b*, respectively, of the wireless communication terminal device 200.

In the present embodiment, the antenna terminal 431*a* and the earphone terminal 432*a* are provided independently. Alternatively, the present embodiment may be arranged so that, as with the earphone antenna device 100*a* in FIG. 5, the antenna terminal 431*a* and the earphone terminal 432*a* are integrally formed to be a multi-pin connector 333, and the plug terminals 331*b* and 332*b* of the wireless communication terminal device 200 are integrally formed to be a multi-pin connector (not shown) whose shape corresponds to that of the multi-pin connector 333.

Figure 11:
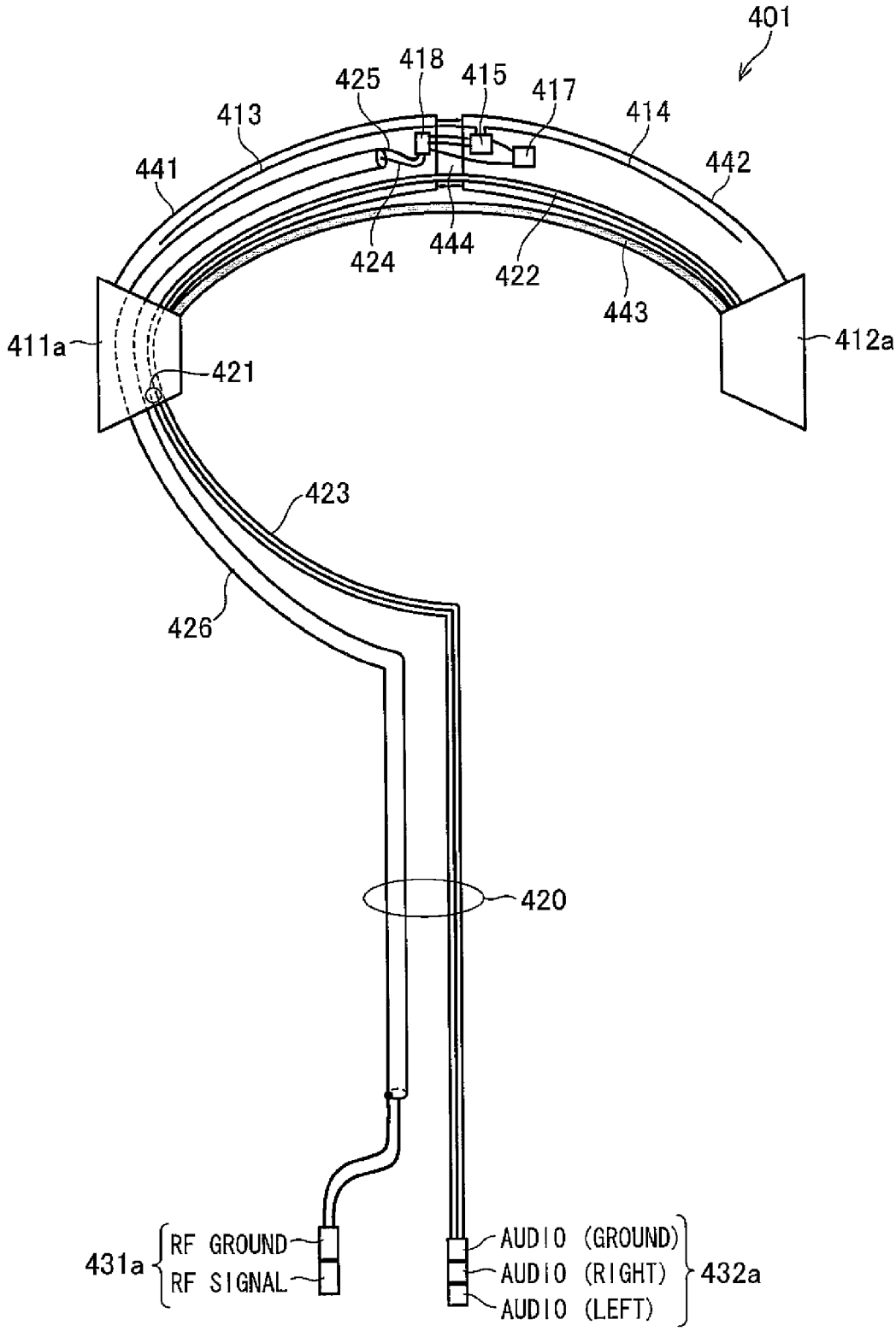
FIG. 11 is a drawing for illustrating another embodiment of a headphone antenna device of the present invention.

Further, in the headphone antenna device 400 of the present embodiment, the left earphone section 411 and the right earphone section 412 are electrically connected with the earphone terminal 432*a* via audio cables 421 and 422 for transmitting audio signals. In the headphone antenna device 400 of the present embodiment, the audio cables 421 and 422 diverge from a cable 420 and are connected with the left earphone section 411 and the right earphone section 412, respectively. Alternatively, the present embodiment may be arranged so that one of the audio cables 421 and 422 goes through one of a left earphone section 411*a* and a right earphone section 412*a* and is connected with the other of the left earphone section 411*a* and the right earphone section 412*a*. FIG. 11 illustrates a structure in which one of the audio cables 421 and 422 goes through the left earphone section 411. In this case, the right audio cable 422 is connected with the right earphone section 412 via the left earphone section 411, the left earphone supporter 441, and the right earphone supporter 442.

Further, a first antenna element 413 and a second antenna element 414 (for convenience of explanation, the first antenna element 413 and the second antenna element 414 may be hereinafter referred to as "antenna element 413" and "antenna element 414", respectively) are provided in the left earphone supporter 441 and the right earphone supporter 442, respectively. Each of the antenna elements 413 and 414 is made of a conductive line or a conductive plate. When each of these antenna elements is a conductive plate whose width ranges from approximately 3 mm to 20 mm or a conductive line whose diameter is 1 mm or more for example, these antenna elements are more likely to have a gain and a band width suitable for an antenna. Further, the left earphone supporter 441 and the right earphone supporter 442 may serve as the left antenna element 413 and the right antenna element 414, respectively. In that case, a connecting section between the left earphone supporter 441 and the right earphone supporter 442 electrically insulates the left antenna element 413 and the right antenna element 414 from each other.

Figure 10:
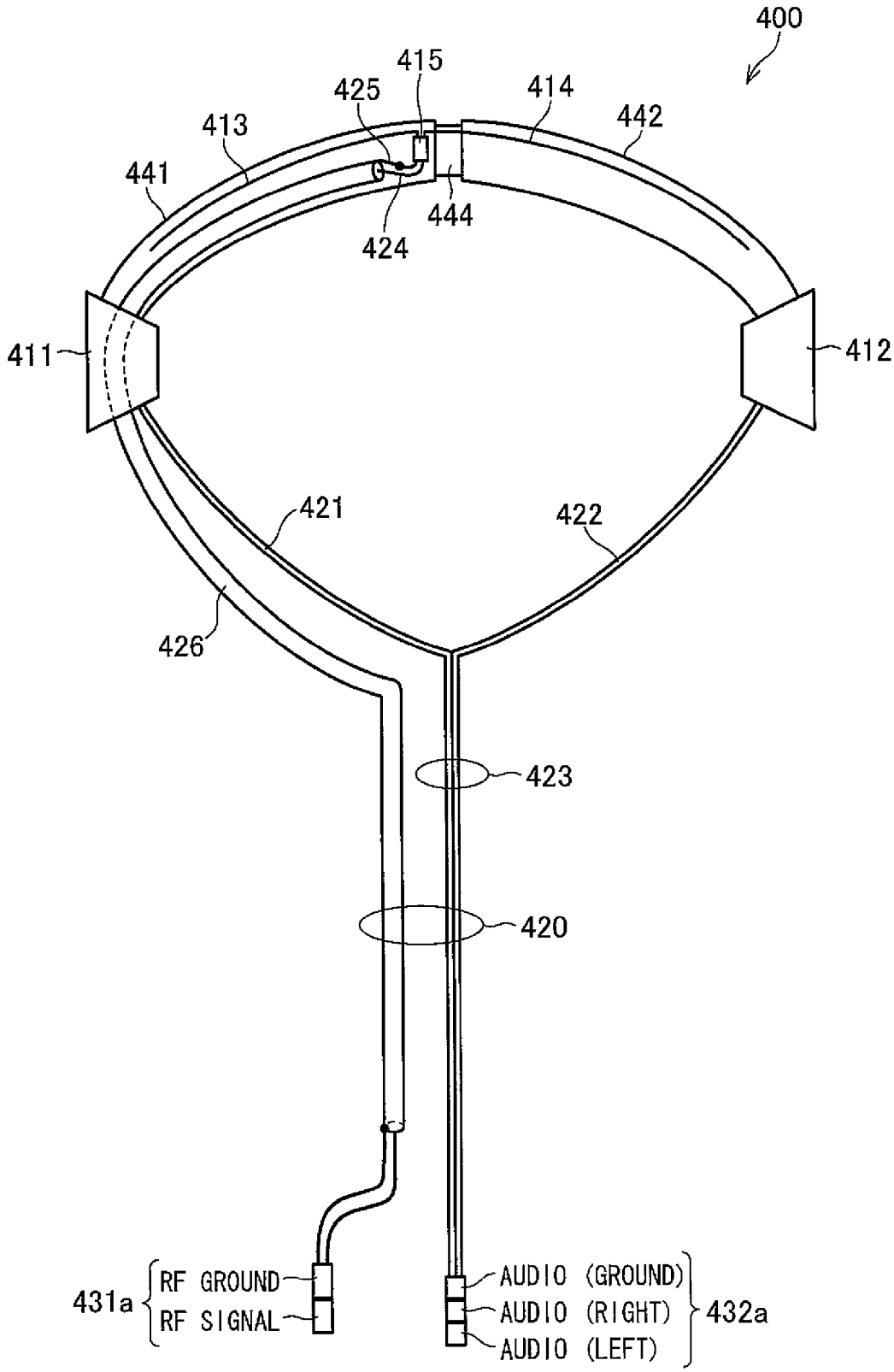
FIG. 10 is a drawing for illustrating an embodiment of a headphone antenna device of the present invention.

An end portion of the antenna element 413 is provided along the left earphone supporter 441, and an end portion of the antenna element 414 is provided along the right earphone supporter 442. The other ends of the antenna elements 413 and 414 are connected with balanced-side terminals of a balanced-unbalanced converter 415. As illustrated in FIG. 10, the balanced-unbalanced converter 415 may be provided near a connecting section between the left earphone supporter 441 and the right earphone supporter 442. Further, the balanced-unbalanced converter 415 may be provided at any one of the left earphone supporter 441, the right earphone supporter 442, the left earphone section 411, the right earphone section 412, the supporter-length adjustment section 444, etc.

At unbalanced-side terminals of the balanced-unbalanced converter 415, a signal output is connected with a signal line 424 of a coaxial cable 426 and a ground output is connected with a ground line 425 of the coaxial cable 426. In FIG. 10, the balanced-unbalanced converter 415 is provided near the connecting section between the left earphone supporter 441 and the right earphone supporter 442, and therefore the coaxial cable 426 goes through the left earphone supporter 441 and the left earphone section 411 and gets together with the audio cables 421 and 422 to form the cable 420. Well-known change of wiring may be suitably performed, such as the coaxial cable 426 going through the right earphone supporter 442.

Signals received by the antenna elements 113 and 114 are converted by the balanced-unbalanced converter 415 into signals in an unbalanced mode. The signals are transmitted from the balanced-unbalanced converter 415 to the antenna terminal 431*a* via the coaxial cable.

On the other hand, ground line portions of the left audio cable 421 and the right audio cable 422 are electrically connected with each other at the balanced-unbalanced converter 415 to be a common ground line which is connected with the earphone terminal 432*a*. An audio cable 423 includes three cables: a right audio signal line, a left audio signal line, and the common ground line.

Further, the antenna elements 413 and 414 and the audio cables 421 and 422 are individually covered with insulators. Further, the antenna element 413 and the left audio cable 421 are integrally covered with an insulator, and the antenna element 414 and the right audio cable 422 are integrally covered with an insulator.

Further, the coaxial cable 426 including the balanced-unbalanced converter 415, and the audio cable 423 that transmits audio signals, are individually covered with insulators, and the coaxial cable 426 and the audio cable 423 thus covered are integrally covered with an insulator. Thus, these cables are integrated and appear to be one cable that is the cable 420.

As with Embodiment 1, the lengths of the antenna elements 413 and 414 are determined by operation areas of the antennas. For example, when the operation area of the antenna corresponds to UHF band, lengths L1 and L2 of the antenna elements 413 and 414, respectively, are approximately 15 cm. When the operation area of the antenna corresponds to VHF band, the lengths L1 and L2 of the antenna elements 413 and 414, respectively, are approximately 30 cm. When the operation area of the antenna corresponds to FM broadcasting band, the lengths L1 and L2 of the antenna elements 413 and 414 are approximately 80 cm. Further, as with Embodiment 1, the present embodiment may be arranged so that at least one of the left earphone section 411 and the right earphone section 112 is made of a conductor such as an aluminum plate and the antenna elements 413 and 414 are formed to include the left earphone section 411 and the right earphone section 412, respectively. Further, as shown in FIG. 4, the present embodiment may be arranged so that a line made of an antenna element with a spiral shape is provided in at least one of the left earphone section 411 and the right earphone section 412.

In the headphone antenna device 400 of the present embodiment, the antenna elements 413 and 414 constitute a dipole antenna as with the case of the earphone antenna device 100 of Embodiment 1. Signals received by the antenna elements 413 and 414 are balanced signals, and converted by the balanced-unbalanced converter 415 into RF signals in a coaxial mode (unbalanced signals). The RF signals are transmitted via the coaxial cable 426 and transmitted via a connector 331 with which the antenna terminal 431*a* and the plug terminal 431*b* are connected, and the RF signals are supplied to the TV tuner 202 of the wireless communication terminal device 200.

As with the case of the earphone antenna device 100 of Embodiment 1, in the headphone antenna device 400 of the present embodiment, the antenna elements 413 and 414 and the coaxial cable 426 (including a ground terminal) that transmit reception signals are separated by an insulator from the audio cable 423 that transmits audio signals. The antenna elements 413 and 414 and the coaxial cable 426 function as an electric circuit made of lines independent from a line of the audio cable 423, and the audio cable 423 functions as an electric circuit made of a line independent from lines of the antenna elements 413 and 414 and the coaxial cable 426.

Consequently, low frequency noises and high frequency noises from the wireless communication terminal device 200 that are transmitted via the plug terminal 332*b* of the wireless communication terminal device 200 are hardly combined with the coaxial cable 426 that constitutes the antenna.

As shown by a headphone antenna device 401 in FIG. 11, the present embodiment may be arranged so that a power-supply circuit 417 is provided in the left earphone supporter 441 or the right earphone supporter 442 and a power is supplied to the antenna elements 413 and 414 via vicinity of the connecting section between the left earphone supporter 441 and the right earphone supporter 442, allowing the antenna elements 413 and 414 to receive signals. In FIG. 11, the power supply circuit 417 is provided in the right earphone supporter 442. This structure allows use of various antenna elements in addition to a conductive line whose diameter is 1 mm or more and a conductive plate whose width ranges from approximately 3 mm to 20 mm. That is, this structure allows formation of an antenna capable of sensitively receiving signals with little influence of a human body.

Further, the power supply circuit 417 may supply a power to the balanced-unbalanced converter 415 in order to give a variable capacity function of a diode to the balanced-unbalanced converter 415 and to change a reception band width. This structure allows enlarging a band width. Further, this structure allows a power for operating the balanced-unbalanced converter 415 to be supplied from a battery such as a button battery, which makes it unnecessary to supply a power from the coaxial cable 426. Consequently, noises ranging from a low frequency to a high frequency that are transmitted from the wireless communication terminal device 200 via the plug terminal 332*b* of the wireless communication terminal device 200 and noises from a power source are hardly combined with the balanced-unbalanced converter 415 and the antenna elements 413 and 414 that constitute the antenna.

Further, the headphone antenna device 400 may include a reception signal amplification circuit 418 for amplifying a received radio signal. The reception signal amplification circuit 418 is supplied with a power by the power supply circuit 417. This structure allows amplifying a received signal at a position distant from the wireless communication terminal device 200 and then transmitting the received signal to the wireless communication terminal device 200. Consequently, this structure allows reduction of the noises ranging from a low frequency to a high frequency that are transmitted from the wireless communication terminal device 200 and the noises from a power source. That is, this structure allows amplification of the signal at a position distant from a noise source of the wireless communication terminal device 200, allowing compensation of the loss of a high frequency in the coaxial cable 426 without amplifying noises that are emitted from the wireless communication terminal device 200 to the air. This allows transmission quality (reception sensitivity) and transmission efficiency of the received signal to be higher and allows the coaxial cable 426 for transmission to have a thin structure. The coaxial cable 426 with a thin structure allows the cable 420 for the headphone antenna device 400 to have a thin structure, allowing the headphone antenna device 400 to have a more convenient arrangement of cables and to be more conveniently carried.

Further, as in the case of the headphone antenna device 401 in FIG. 11, a spacer 443 made of an insulating material may be provided between: the left earphone supporter 441 and the right earphone supporter 442; and a user's head, i.e., below the left earphone supporter 441 and the right earphone supporter 442.

When the spacer 443 is provided between: the left earphone supporter 441 and the right earphone supporter 442; and the user's head, the user's head does not contact directly with the antenna elements 413 and 414 of the headphone antenna device 401. The spacer 443 may have any shape as long as the user's head does not contact directly with the antenna elements 413 and 414. The spacer 443 has a thickness of 1 cm or more for example. When the spacer 443 has an enough thickness, the user feels better while wearing the headphone antenna device 400. Further, when the spacer 443 has an enough thickness, cables such as the audio cables 421 and 422 and the coaxial cable 426 can be contained in the spacer 443, which assembles wiring.

Further, because the spacer 443 is made of an insulating material, the antenna elements 413 and 414 can be positioned away from an obstacle against radio waves, such as a human body. This provides sufficient reception characteristics. The spacer 443 is preferably made of a dielectric material that transmits radio waves. The spacer 443 may be made of vinyl resin or styrol resin for example.

For example, in a case of the spacer 443 having the above structure whose thickness is approximately 2 cm, reception sensitivity of the antenna elements 413 and 414 are higher by 2 dB.

Figure 12:
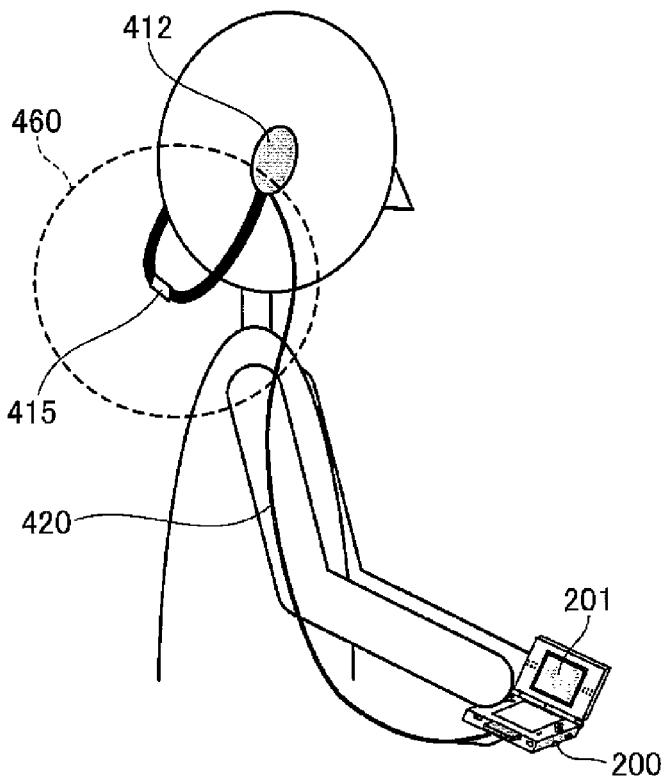
FIG. 12 is a drawing for illustrating an embodiment of a headphone antenna device of the present invention, illustrating how to use the headphone antenna device of the present invention.

In order that a user wears the headphone antenna device 400 more easily, the headphone antenna device 400 may have an arched shape that extends from one ear of the user to the other ear via the back of the user's neck/the back of the user's head, as illustrated in FIG. 12 for example. In a case where the wireless communication terminal device 200 is a portable TV etc., such as in the case of the present embodiment, the user is likely to incline the user's head forwards to see the display 201 of the wireless communication terminal device 200. When the user has such a posture, the headphone antenna device 400 is likely to drop from the user's ears because of the weight of the headphone antenna device 400. Accordingly, the headphone antenna device 400 may be provided with hooks for holding the headphone antenna device 400 at the user's ears.

This structure allows providing a space around the headphone antenna device 400 in a rear portion 460 (space section) of the headphone antenna device 400.

That is, there is provided a space section for providing a space between: the earphone supporters 441 and 442; and the supporter length adjustment section 444.

With the structure, the number of areas where the headphone antenna device 400 touches the user is reduced, allowing the antenna elements 413 and 414 to be distant from an obstacle (e.g. a human body) against radio waves. This allows the headphone antenna device 400 to have sufficient reception characteristics.

Further, in the structure illustrated in FIG. 12, the user exists between the wireless communication terminal device 200 and the headphone antenna device 400. Accordingly, noises from the wireless communication terminal device 200 are absorbed by the body of the user. Therefore, the headphone antenna device 400 is further less likely to be influenced by the noises from the wireless communication terminal device 200.

Figure 13:
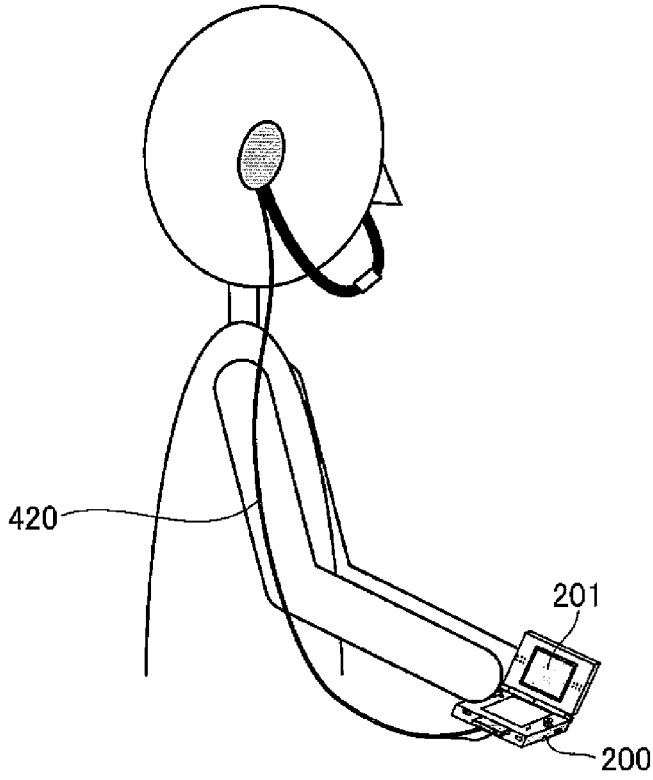
FIG. 13 is a drawing for illustrating another embodiment of a headphone antenna device of the present invention, illustrating a state in which the headphone antenna device worn at the rear side of a user in FIG. 12 is worn at the front side of the user.

For the sake of usability, the headphone antenna device 400 may have an arched shape that extends from one ear of the user to the other ear via the front of the user's neck/the user's jaw, as illustrated in FIG. 13.

Embodiment 3

Figure 14:
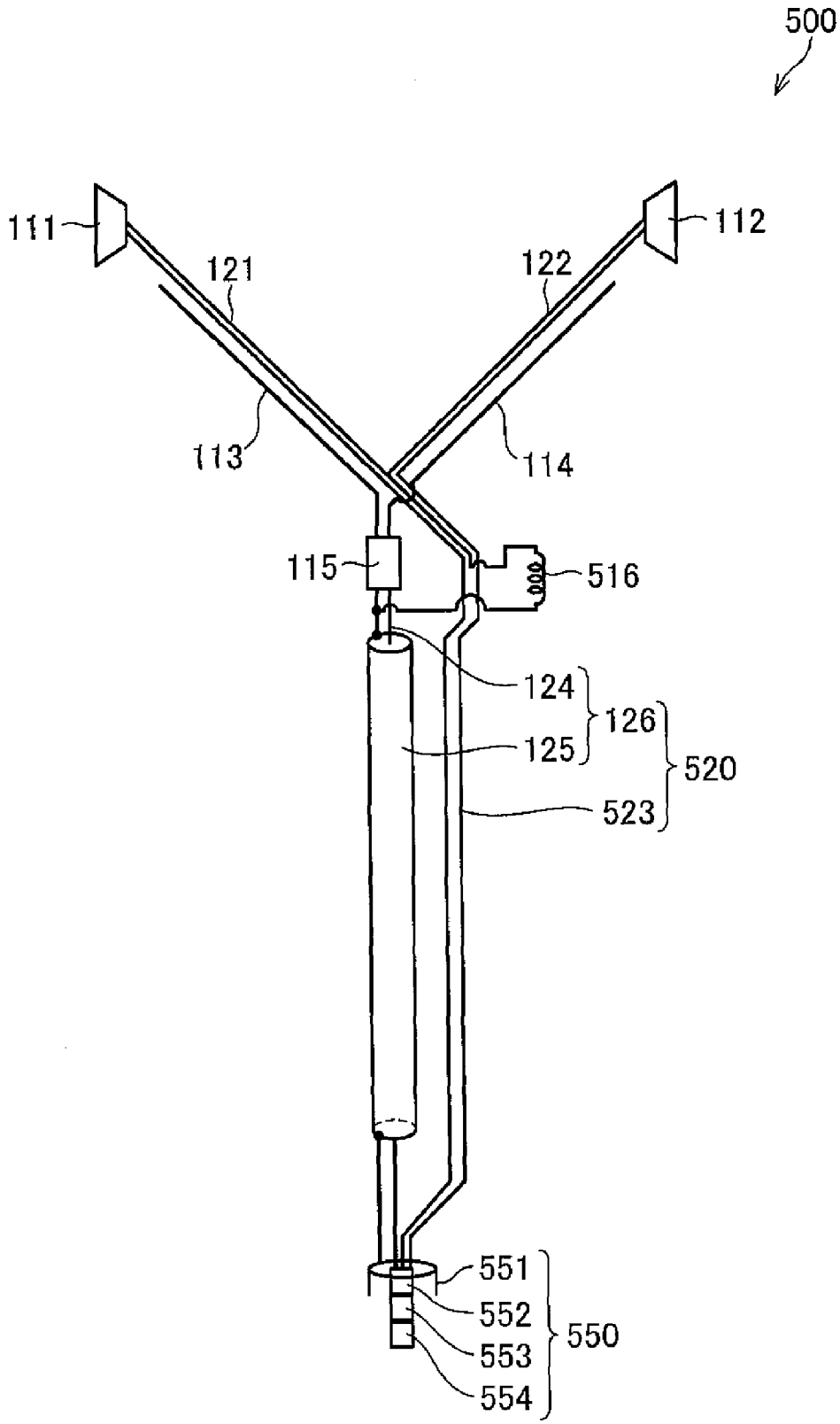
FIG. 14 is a drawing for illustrating another embodiment of an earphone antenna device of the present invention, illustrating a modification example of a connection method in which the ground line of the antenna and the ground line of the audio cable in FIG. 1 are shared in common.
Figure 15:
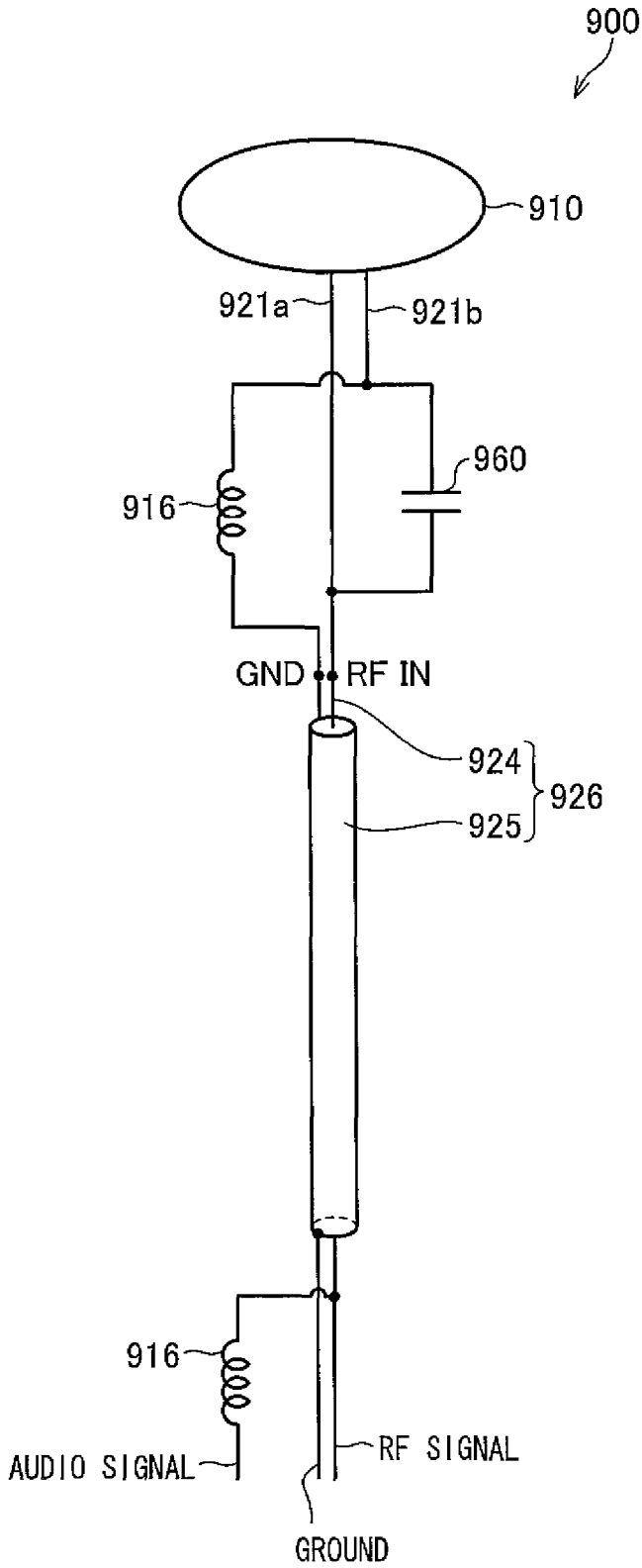
FIG. 15 is a drawing for illustrating a conventional earphone antenna device.

The following explains another embodiment of the present invention with reference to FIG. 14.

Structures other than structures explained in the present embodiment are the same as those in Embodiment 1. For convenience of explanation, members having the same functions as those in drawings of Embodiment 1 are given the same reference signs and explanations thereof will be omitted here.

In the present embodiment, ground lines of audio cables 121 and 122 that are described in Embodiment 1 form a common ground line, which is connected with a ground line 125 of a coaxial cable 126 via an inductor (high-frequency choke) 516 for preventing transmission of a high-frequency signal.

In an earphone antenna device 500 having the above structure, a ground line is shared in common by a circuit for transmitting an audio signal and by a circuit for transmitting a reception signal. Accordingly, it is necessary to separate a high-frequency circuit (reception signal) and a low-frequency circuit (audio signal) by use of the inductor 516.

However, in the present embodiment, the audio cables 121 and 122 and an audio cable 523 transmit audio signals whose frequency is several ten kHz at the most, and the antenna elements 113 and 114 that constitute an antenna and the coaxial cable 126 transmit a high-frequency signal whose frequency is 100 MHz or more. Accordingly, it is comparatively easy for the inductor 516 to remove noises of a high-frequency that are transmitted via the audio cables 121, 122, and 523 and disturb the circuit constituting the antenna.

Further, in general, a ground line in the wireless communication terminal device 200 serves as both a ground line of an audio cable and a ground line of an antenna. The earphone antenna device 500 with the above structure allows the ground line of the wireless communication terminal device 200 to be shared in common by an audio cable and an antenna as with conventional cases. This makes it very easy to form wiring of a circuit substrate of the wireless communication terminal device 200.

A plug terminal of the earphone antenna device 500 of the present embodiment may be a quadripolar terminal 550 obtained by providing a conventional tripolar plug for a stereo earphone with a ground terminal 551 for covering the tripolar plug in a coaxial manner.

With the arrangement, terminals 552 and 553 used as left and right audio signal lines and a terminal 554 used as a signal route for an antenna signal constitute the tripolar terminal, and the ground terminal 551 is connected with a ground line that serves as both a ground line for an audio signal and a ground line for an antenna. Further, with the arrangement, the earphone antenna device 500 in which the ground line for an audio signal and the ground line for an antenna are common is connected with the wireless communication terminal device 200 via quadripolar terminal 550.

Polarity of the quadripolar terminal 550 is not limited to the above connection. For example, the present embodiment may be arranged so that a tripolar terminal is made according to polarity used in a conventional stereo earphone and a signal line for an antenna is connected with the ground terminal 551.

Further, the connecting terminal may be the multi-pin connector 333 illustrated in FIG. 5 or may be such that the antenna terminal 331*a* and the earphone terminal 332*a* are provided separately as illustrated in FIG. 1.

The present invention is not limited to the above embodiments, and a variety of modifications are possible within the scope of the following claims, and embodiments obtained by combining technical means respectively disclosed in the above embodiments are also within the technical scope of the present invention.

In order to solve the foregoing problems, the earphone antenna device of the present invention is an earphone antenna device, operable to be connected with a terminal device having a wireless communication function, made by integrating (i) an earphone device with (ii) an antenna device, the earphone antenna device including: two earphone cables, connected with a pair of left and right earphone sections, respectively, for supplying audio signals to the earphone sections; and an audio common cable, one end of which is connected with the terminal device and the other end of which is connected with the two earphone cables, the earphone antenna device further including: a pair of string-shaped antenna elements, being insulated from the earphone cables and being integrated with the earphone cables; and an antenna coaxial cable, one end of which is connected with the terminal device and the other end of which is connected with the antenna elements, the antenna coaxial cable being insulated from the audio common cable and being integrated with the audio common cable.

With the arrangement, the string-shaped antenna elements are integrated with the earphone cables for supplying audio signals to the earphone sections, while the string-shaped antenna elements being electrically insulated from the earphone cables. Further, the antenna coaxial cable connected with the antenna elements is integrated with the audio common cable connected with the two earphone cables, while the antenna coaxial cable being electrically insulated from the audio common cable.

Accordingly, the audio cable and the line for the antenna are provided separately. This allows suppressing the influence of electromagnetic wave noises from the wireless communication terminal device.

Further, it is preferable to arrange the earphone antenna device of the present invention so that the antenna coaxial cable includes a signal line (signal conductor) and a ground line (ground conductor), and at least one of the signal line and the ground line is directly or indirectly connected with at least one of the string-shaped antenna elements.

Further, the earphone antenna device of the present invention may be arranged so that the string-shaped antenna elements are contained in a coating insulator whose external shape allows the coating insulator to be attached to any object while the antenna elements being provided independently of the earphone cables. In this case, the coating insulator has a strap-shape.

As described above, the earphone antenna device of the present invention includes: a pair of string-shaped antenna elements, being insulated from earphone cables while being integrated with the earphone cables; and an antenna coaxial cable, one end of which is connected with a terminal device and the other end of which is connected with the antenna elements, the antenna coaxial cable being insulated from an audio common cable while being integrated with the audio common cable.

Further, as described above, the earphone antenna device of the present invention includes: a pair of antenna elements, extending from a center of the supporter toward earphone sections at both sides of the supporter, the antenna elements being insulated from earphone cables and being provided along the supporter; and an antenna coaxial cable, one end of which is connected with a terminal device and the other end of which is connected with the antenna elements, the antenna coaxial cable being insulated from an audio common cable while being integrated with the audio common cable.

Accordingly, the audio cable and a line for constituting an antenna are provided separately. Further, the line for constituting an antenna is included in the antenna coaxial cable. Consequently, it is possible to suppress the influence of electromagnetic noises from the wireless communication terminal device.

That is, it is possible to provide an earphone antenna device that is less likely to be influenced by noises of low frequencies and high frequencies from the wireless communication terminal device and by noises transmitted via the audio signal cable.

As described above, the dipole antenna device of the present invention includes: a pair of string-shaped antenna elements; an antenna coaxial cable connected with the antenna elements; and an unbalanced-balanced converter (balun) provided between the antenna elements and the antenna coaxial cable, the antenna elements being at least made of flexible lines.

As the line that constitutes the antenna is included in the antenna coaxial cable, it is possible to suppress the influence of electromagnetic wave noises from the wireless communication terminal device. Further, as the antenna elements are made of flexible lines, the shape of the dipole antenna can be changed according to necessity.

That is, it is possible to provide a dipole antenna device that is hardly influenced by noises of low frequencies and high frequencies from the wireless communication terminal device and by noises transmitted via the audio signal cable, and that has an antenna whose shape can be changed according to necessity.

In order to solve the foregoing problems, the dipole antenna device of the present invention is an antenna device, operable to be connected with a terminal device having a wireless communication function, the dipole antenna device including: a pair of string-shaped antenna elements; an antenna coaxial cable, connected with the antenna elements; and an unbalanced-balanced converter (balun), provided between the antenna elements and the antenna coaxial cable, the antenna elements being at least made of flexible lines.

With the arrangement, the string-shaped antenna elements made of flexible lines are connected with the antenna coaxial cable via the unbalanced-balanced converter (balun), thereby forming a dipole antenna.

Thus, a cable extending from the wireless communication terminal device to the balanced-unbalanced converter consists of the antenna coaxial cable. Accordingly, it is possible to connect lines from the wireless communication terminal device that emits noises to the antenna elements while suppressing the influence of the noises.

Further, the balanced-unbalanced converter has a band-pass property and serves as a filter for preventing transmission of frequency components other than a frequency component with a targeted band to be transmitted. Accordingly, it is possible to suppress noises of low frequency components and high frequency components other than a band to be transmitted as a reception signal.

Further, as the string-shaped antenna elements are made of flexible lines, it is possible to change the shape of the dipole antenna.

Further, it is preferable to arrange the dipole antenna device of the present invention so that the string-shaped antenna elements are contained in a coating insulator that has a shape allowing the dipole antenna device to be attached to any object. Further, the coating insulator may have a strap-shape.

With the arrangement, the shape of the insulator allows the earphone antenna device to be attached to any object or semi-fixed so that the earphone antenna device is easy to use.

Further, when the insulator has a strap-shape, the earphone antenna device is easily hung at the object or the neck of a human body.

As described above, the wireless communication terminal device of the present invention includes the earphone antenna device or the dipole antenna device.

Accordingly, it is possible to provide a wireless communication terminal device that is hardly influenced by noises of low frequencies and high frequencies emitted from the wireless communication terminal device and by noises transmitted via the audio signal cable.

The present invention is applicable to lines in which a signal line for reception is provided along a signal line for low frequency. In particular, the present invention is applicable to (i) a dipole antenna device and an earphone antenna device in each of which lines for antennas and an audio cable are provided along each other, and (ii) a wireless communication terminal device connected to the dipole antenna device or the earphone antenna device.

Accordingly, the present invention is usable in the fields for manufacturing various antenna devices such as earphone antenna devices and dipole antenna devices and components thereof. Further, the present invention is usable in the fields of wireless communication modules and wireless communication terminal devices that include the antenna devices.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. An earphone antenna device, operable to be connected with a terminal device having a wireless communication function, made by integrating (i) an earphone device in which two earphone sections are provided at both sides, respectively, of a supporter, with (ii) an antenna device, said earphone antenna device comprising:

two earphone cables, connected with the two earphone sections, respectively, for supplying audio signals to the earphone sections; and an audio common cable, one end of which is connected with the terminal device and the other end of which is connected with the two earphone cables, said earphone antenna device further comprising:

a pair of antenna elements, extending from a center of the supporter toward the earphone sections, respectively, at both sides of the supporter, the antenna elements being insulated from the earphone cables and being provided along the supporter; and an antenna coaxial cable, one end of which is connected with the terminal device and the other end of which is connected with the antenna elements, the antenna coaxial cable being insulated from the audio common cable and being integrated with the audio common cable, wherein each of the earphone cables includes a signal line and a ground line, and the ground line of each earphone cable is connected with a ground line of the antenna coaxial cable via a high-frequency choke coil, so that a ground line of each of the antenna elements doubles as a ground line of each of the earphone sections.

2. The earphone antenna device as set forth in claim 1, wherein each of the antenna elements has a string-shape or a plate-shape.

3. The earphone antenna device as set forth in claim 1, wherein the supporter has a length adjustment section for adjusting a length of the supporter.

4. The earphone antenna device as set forth in claim 1, wherein a spacer is provided in a space surrounded by the supporter and the earphone sections provided at both sides, respectively, of the supporter, the spacer being provided along the supporter.

5. The earphone antenna device as set forth in claim 1, further comprising power supply means for supplying a power from the center of the supporter to the antenna elements.

6. The earphone antenna device as set forth in claim 1, wherein the antenna coaxial cable includes a signal line and a ground line, and at least one of the signal line and the ground line is directly or indirectly connected with at least one of the antenna elements.

7. The earphone antenna device as set forth in claim 6, further comprising an unbalanced-balanced converter between the antenna elements and the antenna coaxial cable, the signal line and the ground line of the antenna coaxial cable being connected with unbalanced terminals of the unbalanced-balanced converter, and the antenna elements being connected with balanced terminals of the unbalanced-balanced converter, so that the signal line and the ground line of the antenna coaxial cable are indirectly connected with the antenna elements.

8. The earphone antenna device as set forth in claim 6, further comprising power supply means and reception signal amplification means, the power supply means supplying a power to the reception signal amplification means, and the reception signal amplification means amplifying reception signals supplied from the antenna elements and transmitting the amplified reception signals to the terminal device via the antenna coaxial cable.

9. The earphone antenna device as set forth in claim 6, wherein the signal line of the antenna coaxial cable is directly connected with one of the antenna elements, and the ground line of the antenna coaxial cable is directly connected with the other of the antenna elements.

10. The earphone antenna device as set forth in claim 1, wherein the antenna coaxial cable and the audio common cable integrated with each other have an end to be connected with the terminal device, and the end is provided with one or more connecting terminals.

11. The earphone antenna device as set forth in claim 10, wherein the connecting terminals are provided for the audio common cable and the antenna coaxial cable, respectively.

12. The earphone antenna device as set forth in claim 10, wherein the connecting terminal is a multipolar connector connected with both of the audio common cable and the antenna coaxial cable.

13. The earphone antenna device as set forth in claim 1, wherein the antenna elements are contained in a coating insulator whose external shape allows the coating insulator to be attached to any object while the antenna elements being provided independently of the earphone cables.

14. The earphone antenna device as set forth in claim 13, wherein the coating insulator has a strap-shape.

15. A wireless communication terminal device, connected with an earphone antenna device as set forth in claim 1.

16. The wireless communication terminal device as set forth in claim 15, the wireless communication terminal device being portable.

* * * * *